US005228238A

United States Patent [19]

Fenkell

[11] Patent Number: 5,228,238

[45] Date of Patent: Jul. 20, 1993

[54] TRANSPARENT STORM SHUTTER

[75] Inventor: Randall M. Fenkell, Lakeworth, Fla.

[73] Assignee: Gerald Steinberg, Lighthouse Point, Fla. ; a part interest

[21] Appl. No.: 685,954

[22] Filed: Apr. 17, 1991

[51] Int. Cl.[5] ..... E05B 65/04

[52] U.S. Cl. ..... 49/63; 49/125; 49/360

[58] Field of Search ..... 49/61, 62, 63, 67, 56, 49/125, 163, 164, 360

[56] References Cited

U.S. PATENT DOCUMENTS

| | | | |
|---|---|---|---|
| 169,449 | 11/1875 | Knepper | 49/125 X |
| 1,387,062 | 8/1921 | Marshall | 49/125 X |
| 1,492,420 | 4/1924 | Burke et al. | 49/125 X |
| 2,254,150 | 8/1941 | Kingsland | 49/125 X |
| 3,908,730 | 9/1975 | Gross et al. | 49/63 X |
| 4,175,357 | 11/1979 | Goldhaber | 49/56 X |
| 4,199,900 | 4/1980 | Johnston | 49/63 X |
| 4,364,198 | 12/1982 | Netti | 49/63 X |
| 4,685,261 | 8/1987 | Seaquist | 49/62 X |

*Primary Examiner*—Peter M. Cuomo
*Assistant Examiner*—Jerry Redman

[57] ABSTRACT

A storm shutter for protecting glass windows and doors employs one or more transparent unbreakable panels having edges effectively increased in thickness to be retained in respective tracks in the shutter frame, the track having openings narrower than the thickened panel edges. To accommodate different coefficients of thermal expansion for the panel and frame, the track cross-sectional area is considerably larger than the thickened panel edge, yet the narrowed track opening retains the thickened edges, even if the panel is bowed by applied forces. Edge thickening may be effected by securing strips of the panel material along the panel edges. The shutter frame is pivotably mounted on a casing, and a retainer is slidable on the casing to lock or release the frame for pivoting relative to the casing. If the panel is movable along its tracks, a motor has a drive shaft fixed to the casing and about which support strips are wound to pull on the panel. The panel is biased away from the drive shaft to move the panel when the support strips are slack. Pivot pins, each having a ring at one end journaled about the drive shaft, are secured in the frame tracks to permit the frame to be selectively pivoted. For protecting a fixed pane door or window, the shutter casing is secured directly to the window or door frame.

37 Claims, 7 Drawing Sheets

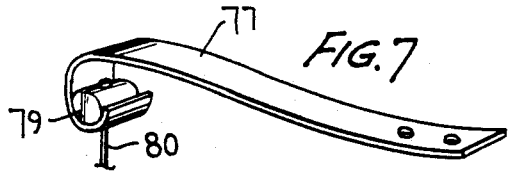
FIG. 7
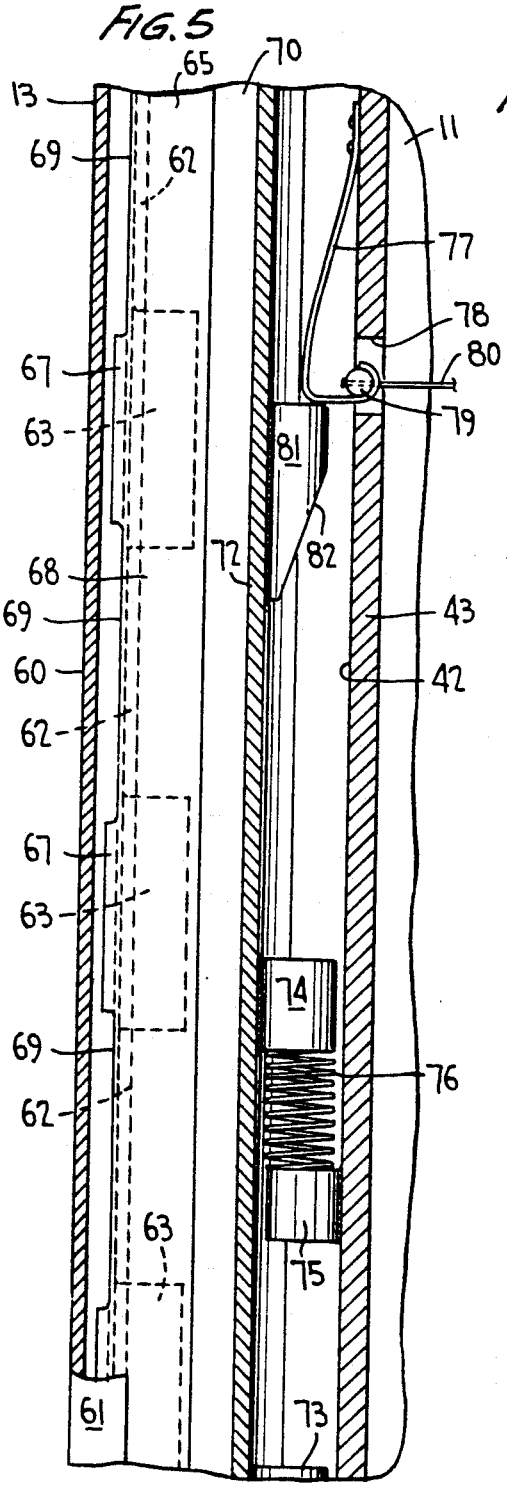
FIG. 5
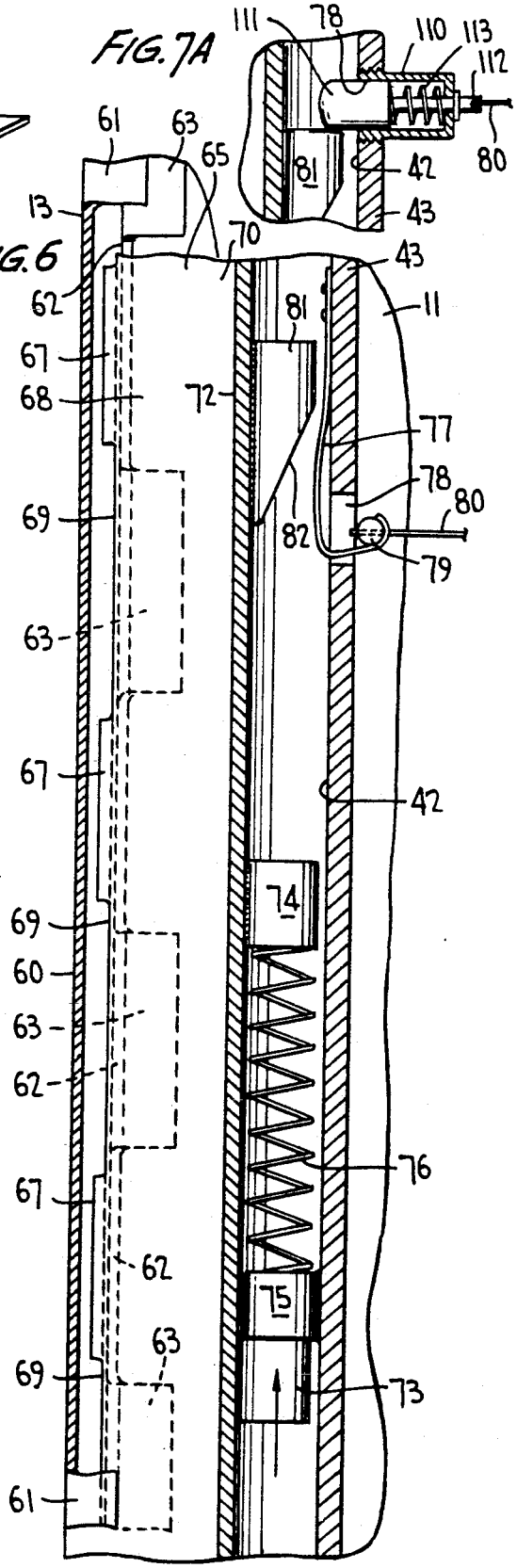
FIG. 6
FIG. 7A

TRANSPARENT STORM SHUTTER

BACKGROUND OF THE INVENTION

1. Technical Field

The present invention relates to methods and apparatus for protecting glass windows and doors from damage due to storms, vandals, and burglars.

2. Discussion of the Prior Art

In geographic areas that are subject to storms of hurricane force it is common to protect glass windows and doors with storm shutters capable of being positioned in front of the outside surface of the glass. Typically, such shutters are made of opaque metal, wood or plastic and configured to be pivoted, slid or rolled into and out of position so that people inside the structure can see out through the glass when there is no storm danger. The need to move these types of shutters into protective position is undesirable. Specifically, if a sudden storm arises, particularly when all occupants are temporarily out of the structure, the windows or doors may be left unprotected. In addition, although some prior art storm shutters are capable of protecting against vandals and burglars, this function is only served when the shutters are moved into position over the glass door or window. Clearly, one could keep the shutters deployed over the door or window at all times and thereby attain permanent protection against storms, vandals, burglars, etc.; however, this would permanently block transmission of light into the structure, thereby nullifying the very purpose of having glass doors and windows.

In U.S. Pat. No. 4,685,261 (Seaquist) there is disclosed a storm shutter comprising a pair of shatter-resistant, translucent panels mounted securely in an aluminum frame that is slidably engaged in brackets secured to the outside of the structure above and below the protected window. The frame is primarily intended to be removed from the brackets when a storm danger has passed, but the patent suggests that the frame may be permanently secured to the brackets. If the frame is permanently secured, the distortion of light provided by the translucent panels is highly undesirable. Moreover, since the translucent panels are fixedly positioned in the frame, an occupant of the structure achieves no ventilation by opening the protected glass window. On the other hand, if the frame is removable from the brackets, it may not happen to be in place to protect the window when sudden storms arise. Further, if not permanently secured to the brackets, the shutter is no deterrent to vandals and burglars. Finally, and of crucial importance, the polycarbonate translucent panels are firmly engaged in an aluminum frame without any allowance for expansion of the panels relative to the frame. Since the coefficient of thermal expansion of polycarbonate is approximately three times that of aluminum, variations in sheet size in response to temperature changes can tear or buckle the aluminum frame.

A protective enclosure for windows disclosed in U.S. Pat. No. 4,175,357 (Goldhaber) includes a shatter-resistant, transparent plastic sheet tightly secured in a metal frame. The frame is mounted for pivotal motion in front of a conventional window and can be supported in an open pivot position to permit outside air to pass through the protected window when the latter is open. A latch, accessible only from inside the protected space, must be actuated before the frame can be pivoted outwardly. Accordingly, this unit satisfactorily protects against burglars and vandals while transmitting light without distortion. However, although the unit can be pivoted to an open position, the resulting opening is not directly aligned with openings in the protected window, thereby limiting the effectiveness of the opening for purposes of ventilation. Of greater importance, however, is the fact that the unit does not provide for the different coefficients of thermal expansion of the plastic sheet and its surrounding frame. Accordingly, the frame is subject to damage from different rates of expansion at extreme ambient temperatures.

Another transparent protective unit is disclosed in U.S. Pat. No. 4,562,666 (Young III). In this unit an unframed sheet of substantially unbreakable transparent polycarbonate is secured to the frame of a conventional window inside the building. Since the sheet itself has no frame, there is no danger of damage resulting from extreme temperature variations. It should be noted, however, that since the unframed transparent sheet is located inside the building, it is subjected to very small variations in temperature in any event. Of course, by being so located, the unit does not protect the conventional window against breakage but instead merely serves to prevent burglars from entering the building through the broken window. If the cause of window breakage happens to be a storm, the mounting arrangement for the polycarbonate sheet is such that it will not prevent wind and rain from entering via the broken window and gaps located between the window frame and the protective unit.

What is clearly lacking in the prior art, therefore, is a transparent storm shutter capable of protecting a glass window or door without being subject to damage caused by different rates of thermal expansion for its component parts, namely the transparent panel and its surrounding frame. Further, the prior art lacks a storm shutter having these features plus the capability of being selectively opened to permit air to flow directly through the protected window when the latter is open.

OBJECTS AND SUMMARY OF THE INVENTION

It is therefore an object of the present invention to provide a storm shutter for permanent installation in front of a protected window while still providing undistorted transmission of light.

It is also an object of the present invention to provide a storm shutter of the type having a transparent and substantially unbreakable plastic sheet secured in a metal frame in a manner permitting the metal frame and plastic sheet to expand and contract independently at different rates in response to ambient temperature variations without applying stress forces to one another.

It is another object of the present invention to provide protection for an openable window by means of a storm shutter having two transparent and substantially unbreakable panels, at least one of which is selectively movable to permit direct air flow through the protected window when it is open.

Another object of the present invention is to provide an improved method and apparatus for mounting transparent and substantially unbreakable plastic storm shutter panels for movement within a metal shutter frame.

A further object of the present invention is to provide an improved method and apparatus for releasably locking a storm shutter frame, or the like, in place over a protected window so that the frame can be selectively pivoted away from the protected window for cleaning and maintenance.

It is yet another object of the present invention to provide a method and apparatus for retaining a transparent and substantially unbreakable storm shutter panel in a metal frame in a manner that permits small thermal expansion and contraction of the panel within the frame while nevertheless preventing the panel from becoming dislodged from the frame.

An additional object of the present invention is to provide an improved method and apparatus for securing a storm shutter to a protected door or window having a fixed pane.

In accordance with one aspect of the present invention, a storm shutter includes two transparent and substantially unbreakable panels, at least one of which is slidably retained in respective pairs of tracks defined in opposite sides of a metal frame. The retained edge portions of each panel have an increased thickness and are held in the tracks by means of a lip defining a track opening and having a smaller width than the panel edge thickness. The panels are thus prevented from being blown out of the tracks when flexed by high winds, or forced out of the tracks by vandals or burglars. However, there is enough slack space in the tracks to accommodate thermal expansion and contraction of the panels relative to the supporting metal frame. In the preferred embodiment of the invention, the increased thickness of the panel edges is obtained by adhesively securing strips of the same panel material along respective panel edges.

The shutter frame is pivotably mounted on a base or casing secured to the building structure about the window opening. A rotary motor, concealed in the base, is selectively operable to rotate a driven tube that rolls or unrolls spaced support strips having their distal ends secured to a movable transparent panel. In the disclosed embodiment the driven tube is disposed above the panels so that the support strips can selectively pull on one of the panels to slide it up in the tracks or permit it to slide down due to its own weight. When the protected window is a double hung unit, engagement flanges are provided on the panels and are positioned to be engaged when the panels are in their closed positions wherein the support strips support the outer panel in its uppermost position, and wherein the outer panel, via the engagement flanges, supports the inner panel in its uppermost position. Actuation of the motor to unroll the support strips permits the outer panel to slide downwardly by its own weight, permitting the inner panel to likewise slide downwardly until it reaches the bottom of the frame. With continued actuation of the motor, the engagement flanges disengage and the strip-supported outer panel slides downwardly independently of the inner panel. In this embodiment the frame is elongated below the bottom of the protected window in order to provide complete clearance for the protected window when the shutter panels are permitted to slide to their extreme downward positions. When the protected window is of the single hung type, the upper shutter panel is fixed, the lower panel is movably controlled by the motor and support strips, and the shutter frame is not elongated.

A locking arrangement prevents the frame from pivoting relative to the casing unless released by an actuator accessible only from inside the building structure. The locking arrangement includes retainers slidably engaged in respective slots on opposite sides of the casing and having a series of alternating tabs and recesses along one of its edges. Corresponding tabs and recesses are defined along a juxtaposed edge of the shutter frame. If the tabs of the frame and retainer are aligned, the frame is prevented from pivoting relative the casing and, thereby, is locked in place. If the retainer is slidably positioned such that the tabs are aligned with recesses, the frame is free to be pivoted away from the casing and can be retained in an open pivot position by means of fold-out support legs. A spring latch mechanism, actuable only from inside the protected building, permits the retainer to be snapped to its open position for emergency egress.

Another embodiment of the shutter is adapted to protect glass doors or windows having a fixed pane and includes a single transparent and unbreakable panel mounted in a frame that is pivotly mounted on a base in the manner described above. The base, or casing, is adhesively secured to the frame of the protected window. The retainer locking arrangement in this embodiment is actuable from outside the protected structure.

BRIEF DESCRIPTION OF THE DRAWINGS

The above and still further objects, features and advantages of the present invention will be apparent upon consideration of the following detailed description of specific embodiments thereof, particularly when taken in conjunction with the accompanying drawings wherein like reference numerals in the various figures are utilized to designate like components, and wherein:

FIG. 5 is a view in section taken along lines 5—5 of FIG. 4 and showing the locking retainer of the shutter assembly in its locked position;

FIG. 6 is a view in section similar to FIG. 5 but showing the locking retainer of the assembly in its open position;

FIG. 7 is a view in perspective of a spring actuator mechanism utilized in connection with the locking retainer illustrated in FIGS. 5 and 6;

FIG. 7*a* is a view in section of an alternative spring actuator mechanism to that illustrated in FIG. 7;

DESCRIPTION OF THE PREFERRED EMBODIMENTS

Figure 1:
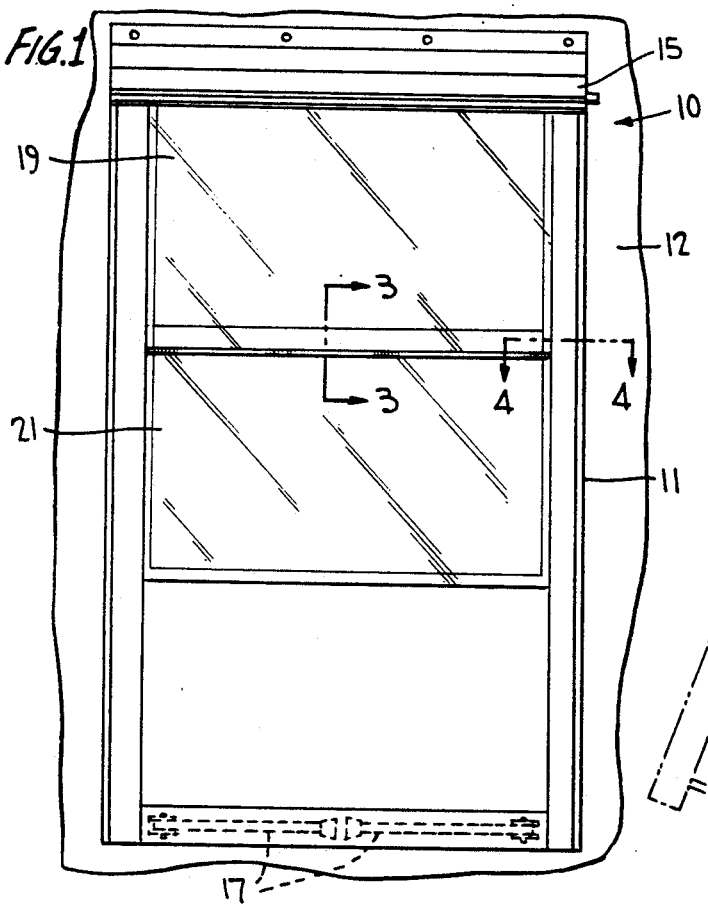
FIG. 1 is a front view in elevation of a sliding panel storm shutter constructed in accordance with the principles of the present invention for use in protecting a double hung window.
Figure 2:
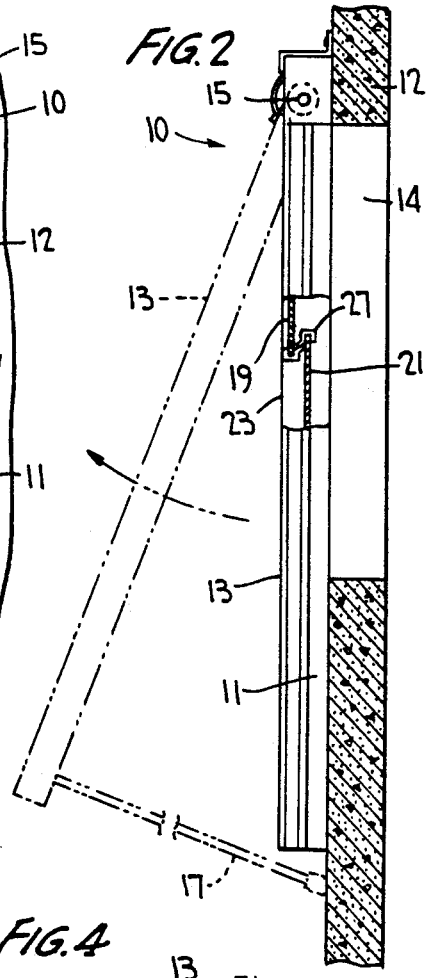
FIG. 2 is a side view in elevation and partial section of the storm shutter assembly of FIG. 1.

Referring specifically to FIGS. 1 and 2 of the accompanying drawings, a storm shutter assembly 10, constructed according to the principles of the present invention, includes a rectangular base or casing 11 secured by threaded bolts, or the like, to the outside surface of the wall 12 of a building having a window opening 14. It is the function of storm shutter assembly 10 to protect a double hung window (not shown) mounted in opening 14, particularly against glass breakage from storms, vandals, and the like. For the shutter assembly embodiment illustrated in FIGS. 1–11, it is assumed that the protected window is of the conventional double hung type with upper and lower sashes movable independently between respective open and closed positions. Casing 11 includes two spaced vertical members joined at their tops and bottoms by spaced horizontal members to enclose a rectangular space. The casing is disposed about the periphery of window opening 14 with the top member of the casing proximate the opening periphery but the bottom member of the casing disposed considerably below opening 14 for reasons described hereinbelow. The interior space defined by casing 11 thus leaves window opening 14 unblocked by the casing.

A rectangular shutter frame 13 is pivotably secured to casing 11 at the top member of the casing to permit the frame to be pivoted outwardly about a horizontal axis 15 in the manner illustrated by the dashed lines in FIG. 2. When so pivoted, the bottom of the frame 13 swings away from the bottom of the casing 11 to permit emergency egress from the building via window opening 14, or to permit cleaning of the shutter panels. When frame 13 is in its closed position (i.e., in its solid line vertical orientation in FIG. 2), it is disposed entirely within the vertical plane defined by casing 11. A pair of fold-out legs 17 are secured to the bottom member of frame 13 and can be selectively folded out or extended to a position wherein their distal ends abut the structure wall 12 to support the frame in its open pivot position. Legs 17, when not so extended, fold up to be disposed along the inside surface of the bottom member of the frame.

Two transparent panels 19, 21 are mounted for slidable movement in respective pairs of vertical tracks defined in frame 13. The panels are typically made of polycarbonate or other suitable plastic material that is substantially unbreakable while retaining its transparency (i.e., without noticeably distorting light images passing therethrough). Suitable material for this purpose is safety glazing material sold under the General Electric trademark LEXAN, or the material sold under the Rohm and Haas trademark TUFFAK. These two materials are only examples of transparent safety glazing material that may be utilized for panels 19, 21, it being understood that other transparent and substantially unbreakable thermoplastic-type polymers and other plastic material may be employed.

When the storm shutter 10 is closed (i.e., in its window-protecting position), exterior panel 19 is disposed with its upper edge at the top of frame 13 and its lower edge overlying the upper portion of interior panel 21. The latter extends downwardly, slightly beyond the bottom edge of the window opening 14, so that the entire window opening is blocked by one or the other of the panels. This leaves an empty space at the bottom portion of frame 13 below window opening 14, the space having approximately the same height as that of one of the panels. When the panels are moved to the fully open position of the shutter assembly 10, both panels overlie that bottom portion of the framed space below window opening 14, leaving the opening unblocked. For this position of the shutter assembly, either sash of the protected double hung window may be opened to permit ventilation of the space inside the building structure without any impediment from the shutter panels.

Figure 3:
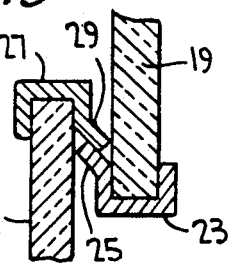
FIG. 3 is a view in section taken along lines 3—3 of FIG. 1.

Referring specifically to FIGS. 2 and 3, a border strip 23 is secured to the bottom edge of exterior transparent panel 19 and extends along most of the width (i.e., horizontal) dimension of the panel. Border strip 23 may be an extruded strip of metal or plastic having a channel contoured between its front and back walls to snuggly receive the bottom edge of panel 19. A suitable adhesive material is employed in the channel to secure strip 23 to the panel. The front and back walls of strip 23 extend a short distance vertically upward along the exterior and interior surfaces, respectively, of panel 19. The top of the rear wall of the strip, however, extends an additional distance obliquely upward toward interior panel 21 to form an engagement flange subtending an acute angle (e.g., ten degrees) with the interior surface of exterior panel 19. A substantially identical border strip 27, having a substantially identical engagement flange 29, is secured along the top edge of interior panel 21. Strip 27 is oriented so that its engagement flange 29 projects obliquely downward toward exterior panel 19. Engagement flanges 25 and 29 are oriented to engage one another so that when the exterior panel 19 is in the extreme upper position in its track, panel 19 supports panel 21 by means of the flange engagement. This constitutes the closed position of the panels wherein they are disposed, with panel 19 at a higher level than panel 21, to block window opening 14. As described hereinbelow, panel 19 is supported in this position by a selectively actuable motor to prevent panel 19, and panel 21 that it supports, from dropping due to their own weight. As exterior panel 19 is lowered by the motor, interior panel 21 lowers with it until the bottom edge of panel 21 reaches the bottom member of frame 13. Thereafter, continued lowering of panel 19 causes the engagement flanges 25 and 29 to disengage, and panel 19 may be lowered further, by itself, until both panels are positioned below the window opening 14. This position constitutes the fully open position of the shutter assembly 10. If panel 19 is raised from the fully open position, it initially moves without panel 21 until flange 25 moves into engagement with flange 29; thereafter, continued raising of panel 19 cause panel 21 to be raised therewith.

Figure 4A:
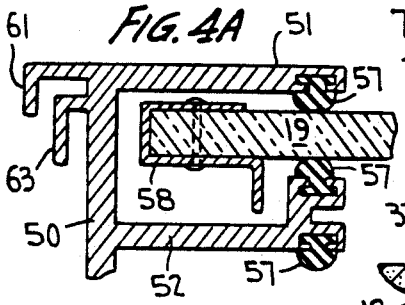
FIG. 4*a* is a view similar to FIG. 4 but showing an alternative embodiment of the invention.
Figure 4:
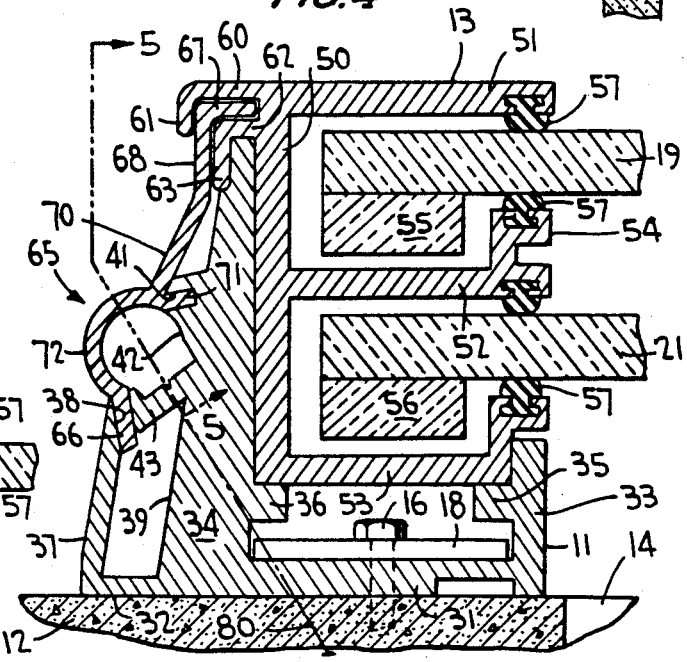
FIG. 4 is a view in section taken along lines 4—4 of FIG. 1.

FIG. 4, to which specific reference is now made, illustrates the transverse cross-sectional configuration of the side members of casing 11 and frame 13. It is to be understood that, although one side member for each of the casing and frame is so illustrated, this illustration is representative of both sides of the shutter assembly. It is also to be understood that FIG. 4, being a lateral section of the frame and casing side members, illustrates lateral length dimensions (i.e., horizontal dimensions) of parts that typically extend vertically (i.e., into the plane of FIG. 4) along the entire height of the frame or casing. The side member of casing 11 is typically an extruded aluminum member having a rear wall 31 with a flat surface 32 adapted to be placed flush against the building structure wall 12 alongside window opening 14. An interior casing edge wall 33 extends perpendicularly forward from the inner edge of wall 31 (i.e., the edge disposed adjacent window opening 14). Typically, the forward length of edge wall 33 is approximately one-third the lateral length of rear wall 31, these length dimensions being those visible in FIG. 4 (as opposed to the length dimensions into the plane of the drawing). An intermediate wall 34, of generally right-triangular lateral cross-section, projects forwardly from rear wall 31 at a location approximately two-thirds of the distance from edge wall 33 to the opposite edge of rear wall 31. Typically, the forward length of intermediate wall 34 is the same as, or slightly less than, the lateral length of rear wall 31. The inwardly facing surface of intermediate wall 34 (i.e., facing edge wall 33) is parallel to edge wall 33. A flange 35 projects from edge wall 33 toward intermediate wall 34, and a similar flange 36, coplanar with and spaced from flange 35, projects from intermediate wall 34 toward edge wall 33. Flanges 35 and 36, with rear wall 31, establish a rectangular channel having a narrowed opening defined between the spaced facing flange ends. This channel serves as a space for receiving a plurality of threaded bolts 16 extended into building structure wall 12 through appropriate holes in rear wall 31 for the purpose of securing the casing side member to the building structure. Suitable washers 18 are disposed in the defined channel between the head of bolt 16 and wall 31. Washers 18 may be square, circular, or other shape and are typically of a larger diameter or width than the channel opening between flanges 35 and 36. The washers are inserted into the channel vertically from an end of the extruded casing side member (i.e., in a direction into the plane of the FIG. 4 drawing) when the casing is being secured to the building structure.

An outer edge wall 37 extends forwardly from the edge of rear wall 31 that is remote from window opening 14. A short proximal portion of edge wall 37 is perpendicular to rear wall 31; however, edge wall 37 bends at a small angle inward toward intermediate wall 34 throughout most of its forward length, the angle typically being on the order of eight degrees. The distal end of edge wall 37 tapers in a plane forming a small acute angle with the outwardly facing surface of wall 37, whereby the distal-most part of that end of edge wall 37 is in the plane of said outwardly-facing surface. The acute angle, typically on the order of sixteen degrees, results in a tapered edge 38 facing generally toward intermediate wall 34 but diverging therefrom at a small angle on the order of eight degrees.

An outer surface 39 of intermediate wall 34 extends forwardly from rear wall 31 at an angle so as to be substantially parallel to the bent portion of edge wall 37. A small sidewardly projecting segment 40 extends from surface 39 and has a generally rectangular channel 41 opening to the side of the casing 11. The depth dimension of channel 41 is at a small angle (e.g., approximately ten degrees) with respect to the plane of rear wall 31, and its interior edge (i.e., the edge closest to rear wall 31) resides on a concave surface 42 of segment 40 extending generally toward rear wall 31. At a location on surface 39 that is slightly closer to rear wall 31, a short wall 43 having a flanged or widened distal end projects generally toward tapered distal edge 38 of outer edge wall 37. Wall 43 defines an angle of approximately fifty-two and one-half degrees with respect to rear wall 31, and its flanged distal end is angled to be parallel to tapered edge 38 of outer edge wall 37. The resulting gap between edge wall 37 and the flanged end of wall 43 is thus defined between two parallel surfaces extending throughout the vertical height of the casing (i.e., into the plane of the drawing in FIG. 4).

The cross-section of the side member of frame 13, as viewed in FIG. 4, is generally E-shaped and includes a main sidewall 50 oriented perpendicular to rear casing wall 31 and disposed flush against the surface of intermediate casing wall 34 that faces inwardly toward the space enclosed by the casing. Three coextensive leg walls 51, 52 and 53 extend in spaced parallel relation from sidewall 50 toward the framed inner space. Wall 51 extends perpendicularly from the exterior end of sidewall 50 and defines an exteriorly-facing exposed surface of the frame 13. Wall 53 extends perpendicularly from the opposite or interiormost end of wall 50, while wall 52 extends perpendicularly from wall 50 at a location substantially midway between walls 51 and 53. The space between walls 51 and 52 defines a track for transparent exterior panel 19, while the space between walls 52 and 53 defines an adjacent track for interior transparent panel 21. It is to be understood that substantially similar mirror image tracks are defined in the opposite side members of frame 13 so that panels 19 and 21 are supported in respective pairs of tracks defined in opposite side members of the frame. Wall 52 has a lip 54 projecting from its distal end generally toward the distal end of wall 51 to define a reduced width for the inwardly facing opening of the track for panel 19. That opening is somewhat larger than the thickness of panel 19, but the portion of the panel disposed inside the track has an increased thickness to prevent it from being removed from the track through the reduced width opening. In the preferred embodiment, the increased thickness of the panel is provided by securing a strip 55 along the entire vertical height of the interiorly facing surface of panel 19 adjacent the vertical panel edge. Of course, a plurality of shorter vertically spaced strips or pieces may be utilized for the same purpose. Strip 55 is made either from the same material as panel 19 or a material having substantially the same coefficient of thermal expansion as the panel material. Alternatively, the panel 19 and strip 55 may be extruded with thickened edges as a single piece of polycarbonate, or the like, rather than adhesively securing separate strips to provide the required edge thickness. As a further alternative, as illustrated in FIG. 4*a*, a series of longitudinally spaced, individual plastic or metal channel members 58 may be secured at the edge of panel 19 by means of rivets, or the like, each including a projection 59 to effectively increase the thickness of the panel edge at the spaced locations and prevent it from fitting through the narrowed track opening. Substantially any structure attached to or formed as part of the panel edges may be employed to increase the effective panel edge thickness so as to assure that the panel is retained in its tracks. The depth of the track for panel 19 (i.e., in the horizontal dimension of the FIG. 4 drawing) is larger than the depth of the combined panel 19 and strip 55, thereby allowing for thermal expansion of the panel in the track and precluding damage to the frame by virtue of such expansion. However, in spite of the slack providing freedom for thermal expansion, the panel cannot be removed transversely through the reduced width track opening because of the increased thickness provided by strip 55 or its equivalent. Thusly supported in two tracks on opposite sides of the frame, panel 19 is also capable of resiliently bending, due to high winds, or the like, without thickened edges 55 being pulled through the narrower track openings.

It will be appreciated that the components in FIG. 4 are not necessarily drawn to scale and that the room for expansion of the transparent panels in their tracks is chosen on the basis of the materials used for the panels and frame and the range of temperatures to be experienced by the assembly. For example, in one practical embodiment using an aluminum frame and LEXAN panels, the depth of the track (i.e., between the facing surfaces of wall 50 and lip 54) is 0.750 inch whereas the width of strip 55 is 0.500 inch. The width of the track (i.e., between the facing surfaces of walls 51 and 52) 0.562 inch, whereas the panel 19 and strip 55 are each 0.236 inch thick. Thus, the channel is typically on the order of fifty percent deeper than the width of the retained strip 55, and typically on the order of nineteen percent wider than the combined thicknesses of panel 19 and strip 55 retained in the track. From a cross-sectional area perspective, the area of the retained portions of panel 19 and strip 55 is 0.236 square inches, whereas the area of the channel is 0.4215 square inches. Consequently, the area of the channel is typically seventy-five percent larger than the area of the retained portions of panel 19 and strip 55. These dimensions, which are provided by way of example only, are taken at room temperature.

Wall 53 of frame 13 has its distal end bent perpendicularly toward wall 52 to provide a similarly reduced width for the opening of the track for panel 21. An increased thickness, in the form of a strip 56, or the like, of panel 21 along its edges prevents that panel from being removed from its tracks through the reduced opening. The relationship between panel 21 and its retaining tracks is the same as the described relationship between panel 19 and its retaining tracks, whereby thermal expansion of panel 21 is permitted so as to preclude damage to the frame, but the thickened edges of the panel are prevented from being removed from the tracks through the narrow track openings. Given the inability to remove the panels from their narrowed track openings, it will be understood that the panels are inserted into the tracks vertically (i.e., into the plane of the drawing of FIG. 4) from one end or the other of the frame at the time the frame is being assembled. Conventional weather stripping elements 57 are provided at the extremities of walls 51, 52 and 53 to face into the track openings and resiliently bear against each surface of the retained panels.

The interior leg 53 of frame 13 rests on the exteriorly-facing surfaces of flanges 35 and 36 which, along with the facing surfaces of walls 33 and 34, define a space in the side member of casing 11 for receiving the side member of the frame. The bent distal end of frame leg 53 extends along the aforesaid facing surface of wall 33 and then bends to extend along the distal edge of that wall. The receiving space in the casing, as thusly defined, is slightly larger than the dimensions of the frame side so as not to interfere with movement of the frame 13 relative to casing 11 when the frame is pivoted outwardly about pivot axis 15 in a manner best illustrated in FIG. 2. This pivotal movement corresponds to upward movement of the frame 13 as viewed in FIG. 4.

During normal operation of the shutter assembly 10, frame 13 is locked in place in casing 11 so that the frame cannot be pivoted about axis 15. The locking arrangement is selectively actuable from inside the structure, in a manner described below, and is tamper-proof so as to prevent vandals and burglars from unlocking the frame from the casing. The structure for locking the frame to the casing is illustrated in FIGS. 4 through 8 to which specific reference is now made.

The side member of frame 13 includes a cover flange 60 extending from the exterior end of wall 50, coplanar with and in the opposite direction from wall 51. Thus, flange 60 extends outwardly from the framed space and, like walls 50, 51, 52 and 53, extends the entire vertical dimension of the frame (i.e., into the plane of the drawing in FIG. 4). Typically, the lateral extension of cover flange 60 is one-quarter of the lateral length of legs 51, 52 and 53. The distal end of cover flange 60 is bent perpendicularly back toward the building structure wall 12 to define a cover lip 61 having a length typically between seventy and seventy-five percent of the lateral extension of the cover flange. A locking flange 62 extends laterally outward from main frame wall 50 in spaced parallel relation to cover flange 60 at a location slightly interior from the cover flange. Locking flange 62 extends laterally a significantly shorter distance than does cover flange 60 before bending back toward the building structure to define a locking lip 63. The location of locking flange 62 along wall 50 is such that, if it were extended without bending to form locking lip 63, it would contact the distal end of cover lip 61. The bend in locking flange 62 defining locking lip 63 is slightly more than ninety degrees (e.g., typically ninety-three degrees) so that it converges slightly toward frame wall 50. At its lateral extremity (i.e., at the bend), the lateral length of locking flange 62 is approximately half the lateral length of cover flange 60. Locking lip 63 has a length substantially the same as the length of cover lip 61. The result is a channel having a generally L-shaped cross-section extending the entire vertical dimension of the frame side between cover flange 60 and lip 61 on the one hand, and the locking flange 62 and lip 63 on the other. A channel of linear cross-section extends the entire vertical dimension of the frame side and subsists between locking lip 63 and the outer surface of main frame wall 50. This linear channel receives the distal portion of intermediate wall 34 of casing 11. In this regard, the distal portion of wall 34 narrows slightly so that it may be accommodated between the main frame wall 50 and the distal end of the slightly converging locking lip 63.

Figure 8:
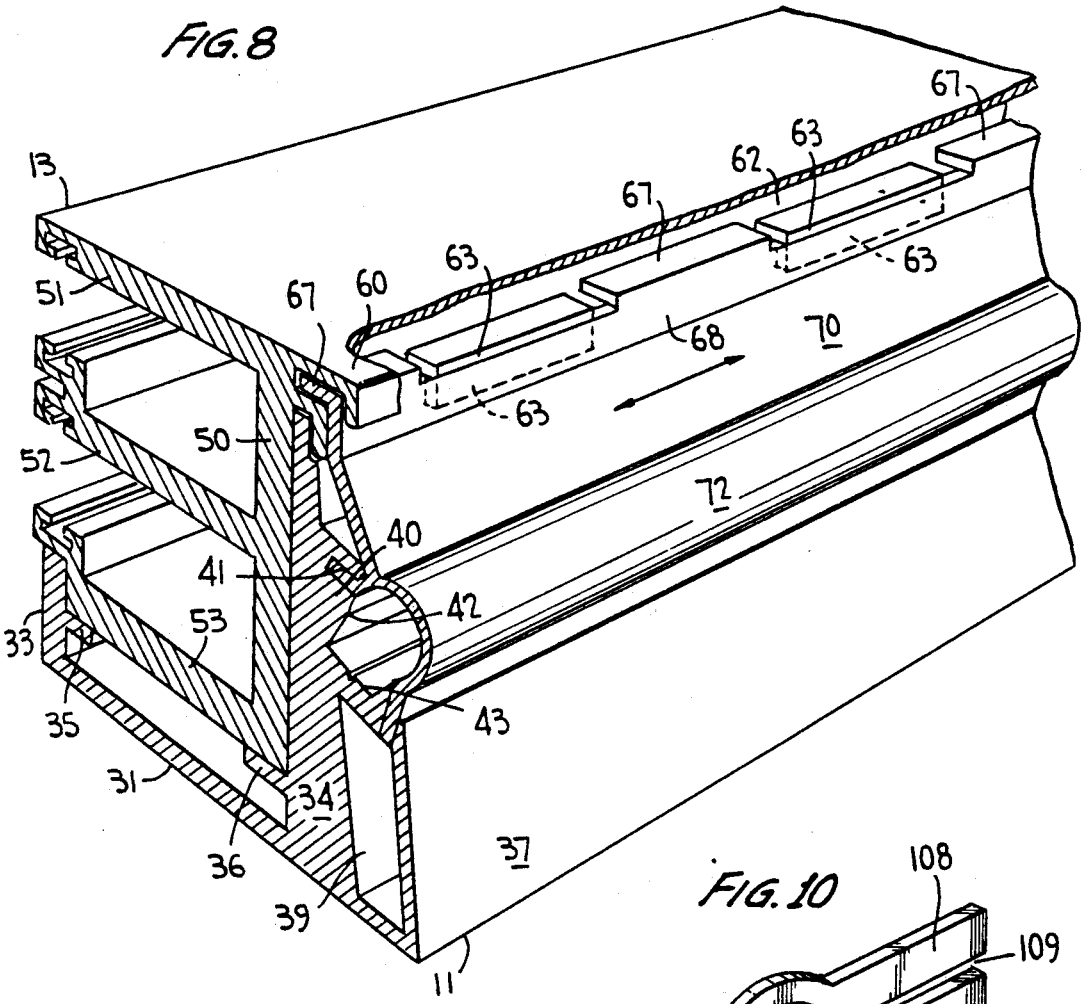
FIG. 8 is a view in perspective and partial section of a portion of the shutter assembly of FIG. 1 showing the locking arrangement in greater detail.

As best illustrated in FIGS. 5, 6 and 8, locking flange 62 and lip 63 have a plurality of recesses defined therein at spaced locations along the vertical length of the frame. These recesses, extending entirely through the locking lip 63 but only part way through the locking flange 62, establish a series of locking tabs formed by the non-recessed portions of the flange and lip. These tabs and the recesses therebetween cooperate with a separate locking retainer 65 configured to releasably secure frame 13 to casing 11. There are two such locking retainers provided with the shutter assembly, one for each side of the frame/casing. Each locking retainer 65 is an elongated plastic or metal member that extends vertically throughout that portion of the vertical length of locking flange 62 and lip 63 in which the alternating recesses and tabs are defined. One side of locking retainer 65 is in the form of a flange 66 slidably received in the gap between tapered edge 38 of casing edge wall 37 and the flanged distal end of wall 43 projecting from surface 39 of casing intermediate wall 34. The gap clearance is such as to permit flange 66 to freely slide longitudinally therein without rattling laterally. The opposite side of locking retainer 65 takes the form of a retainer flange of L-shaped transverse section configured to be slidably received in the channel defined between cover flange 60 and locking flange 62. This retainer flange includes a distal leg 67 disposed between flanges 60 and 62, and a proximal leg 68 disposed between lips 61 and 63. Distal leg 67 is entirely cut-away at a series of vertically spaced locations 69 to define a series of retainer recesses separated by a series of regularly spaced retainer tabs corresponding to the non-recessed portions of distal leg 67. The vertical spacing between these retainer tabs 67 corresponds to the spacing between the locking tabs in locking flange 62 and locking lip 63. The vertical lengths of the locking tabs and the retainer tabs are preferably the same; however, the vertical tab lengths are preferably shorter than the vertical lengths of the locking recesses and retainer recesses. Given these dimensional relationships, when the retainer 65 is vertically positioned such that its retainer tabs 67 are aligned or juxtaposed with the locking tabs 62, 63 (see FIG. 5), frame 13 is prevented from pivoting away from casing 11 by interference between the two sets of tabs. In other words, retainer 65 is secured to casing 11 and, by disposing its retainer tabs 67 in blocking relation to the frame locking tabs 62, 63, the retainer prevents the frame from moving away from the casing (i.e., upward in FIG. 8, to the left in FIGS. 5 and 6).

When retainer 65 is slid vertically to align its retainer tabs with the locking recesses in flange 62, the interference between the two sets of tabs is removed. Since distal retainer leg 67 is laterally shorter than the depth of the recesses in flange 62, the retainer tabs pass freely through those locking recesses as the frame is moved forwardly and away from the casing about pivot 15 (FIG. 2).

The proximal retainer leg 68 extends perpendicularly toward casing rear wall 31 alongside locking lip 63. Proximate the distal end of the locking lip, the retainer is provided with a substantially planar segment 70 that bends at an angle of approximately twenty-five degrees to diverge from locking lip 63. Segment 70 terminates at the projecting segment 40 from intermediate wall 34 at which location the retainer is provided with a flange 71 projecting inwardly toward the casing and configured and positioned to be slidably received in channel 41 of projection 40. This slidable engagement provides additional mounting support for retainer 65 on casing 11. At the same terminus location of retainer segment 70 there is a cylindrically domed segment 72 that bulges outwardly to the side of the assembly. The interior concave surface of dome 72 has the same radius of curvature as concave surface 42 of projection 40 on intermediate wall 34, and these concave surfaces are aligned to provide one arcuate surface extending along both members. These surfaces combine with the facing surface of flange 43 to define an enclosed hollow space between retainer 65 and the casing. It is in this hollow space that the locking mechanism for controlling vertical movement of retainer 65 is located, as best illustrated in FIGS. 5 and 6 and described in the following paragraphs.

A first retainer stop member 73 is secured to the inside surface of dome 72 by any suitable means, such as glue, etc. In the illustrated embodiment, stop member 73 takes the form of a short cylindrical dowel. A similar second retainer stop member 74 is likewise secured to the inside surface of dome 72 at a location vertically spaced from stop member 73. A similar casing stop member 75 is likewise secured to the arcuate surface 42 of projection 40 and is disposed vertically intermediate the retainer stop members 73 and 74. The stop members are configured such that the casing stop member 75 cannot move past either of the retainer stop members 73 and 74 and, therefore, is trapped between the retainer stop members to limit the extent to which the retainer 65 can slide vertically in either direction with respect to casing 11. A helical compression spring 76 is disposed between retainer stop member 74 and casing stop member 75 to continuously urge stop member 74 away from stop member 75. This has the effect of urging stop member 73 toward stop member 75. As a consequence, slidable retainer 65 is continuously biased toward the position shown in FIG. 6 wherein the first retainer stop member 73 abuts casing stop member 75. This is the open position of the frame locking mechanism, for in this position of retainer 65 the retainer tabs 67 are aligned with the locking recesses between locking tabs 62, 63 whereby frame 13 can be pivoted away from casing 11.

A further stop 81 is secured to the inside surface of dome 72 in vertically spaced relation to stop member 74, but on the opposite side thereof from stop member 73. Stop 81 may also be a dowel, but its lower end facing the direction toward stop 74 and stop 73 is cut at a bias angle so as to taper toward the region of attachment to dome 72. The taper provides a camming surface 82 facing generally toward the flanged end of wall 43 and stop 74.

Referring to FIGS. 5, 6 and 7, a further spring 77 is comprised of a sheet of spring metal or plastic bent in a figure-seven configuration. Spring 77 is secured to arcuate segment 42 of casing 11 at a location vertically spaced from retainer stop member 74 in a direction opposite from casing stop member 72. The stem or long leg of spring 77 has its distal end extending away from retainer stop member 74 and secured by screws, adhesive, or the like to concave surface 42 of casing projection 40. The stem of the spring, when unflexed, extends through the hollow space covered by dome 72 at an angle relative to vertical. The head or short leg of the spring extends transversely across the hollow space toward and partially into a hole 78 defined through the flanged end of wall 43. The distal end of the spring head is arcuately bent to partially surround a cylinder 79 attached to a cable or wire 80 extending out through hole 78 and into the interior of the building beyond structure wall 12 (see FIGS. 2 and 4). If cable 80 is pulled from inside the building, the stem of the spring is flexed and the head of the spring is pulled into hole 78.

When helical spring 76 is fully compressed, as shown in FIG. 5, the retainer 65 is positioned so that its tabs 67 are aligned in juxtaposition with locking tabs 62, 63. This is the locked position of the frame, since the locking tabs and retainer tabs mutually interfere to prevent the frame from pivoting away from the casing. Also in this position, the head of the unflexed spring 77 bears against the flat top end of stop 81, thereby preventing retainer 65 from moving from the locked position (FIG. 5) to the unlocked position (FIG. 6). In other words, the force of spring 76 is insufficient to longitudinally buckle spring 77, whereby the latter serves as a latch keeping the retainer in its locked position. If cable 80 is pulled, the head of spring 77 is pulled out of blocking relation with respect to stop 81. Helical spring 76 is then free to move retainer stop 74 relative to casing stop 75, thereby moving the retainer 65 relative to casing 11. This movement continues until retainer stop 73 abuts casing stop 75, thereby placing the retainer in its open position (FIG. 6). In this position, stop 81 is disposed beyond the head of spring 77.

In order to return retainer 65 to its locked position, cable 80 is released to thereby unflex spring 77, and the retainer is moved by hand in opposition to the bias force of helical spring 76. Camming surface 82 facilitates movement of stop 81 past spring 77 during this movement of the retainer since the camming surface rides along the spring stem and urges the spring to its flexed position. When the flat upper end of stop 81 passes the head of the spring, the latter snaps back to its unflexed position. The noise, as well as the tactile sensing, of this snapping action informs the operator that the retainer is latched and can be released without being moved from its locked position.

An alternative spring assembly, for use instead of spring 77, is illustrated in FIG. *7a*. A cylinder 110 is secured in hole 78 with an open end facing inwardly of the domed space. A piston 111 is slidable longitudinally in the cylinder and includes a diametrically enlarged head disposed at the open cylinder end and a narrowed stem 112 projecting out through a small aperture in the closed cylinder end. Trapped between the head of piston 111 and the closed end of cylinder 110 is a helical spring 113 disposed about stem 112. Spring 113 normally biases the head of piston 111 well into the domed space to block stop 81 from moving upward (as viewed in FIG. *7a*). Cable 80 is secured to the piston stem 112 and, if pulled, selectively draws the piston head into the cylinder 110 to unblock stop 81. This permits retainer 65 to move upward to its open position. To move the retainer back to its lock position, downward force is applied to the retainer to permit the cammed surface 82 of stop 81 to force piston 111 back into the cylinder 110 as the stop moves past hole 78. After the stop has cleared the hole, spring 113 snaps piston 111 back into blocking relation to piston 81.

In a typical embodiment, the inside diameter of dome 72 is approximately 0.305 inch, the helical spring 76 has a diameter of approximately 0.290 inch and an axial length when unstressed of approximately six inches, the axial length of spring 76 when fully compressed in the locked position of the retainer is approximately 3.700 inches, the dowels employed for stop members 73, 74 and 75 have diameters of approximately 0.300 inch and lengths of approximately 0.5 inch, stop 81 has a diameter of approximately 0.300 inch and is approximately one inch long with a bias cut of approximately sixty degrees. Spring 77, in this embodiment, has a stem length of approximately one and three-quarter inches, a stem width of approximately 0.230 inch, and a head length (i.e., transversely of the hollow dome interior) of 0.37 inch. This latter dimension is somewhat larger than the inside diameter of dome 72; however, in the preferred embodiment, the head of spring 77 extends partially through access hole 78 when the spring is unstressed.

Figure 10:
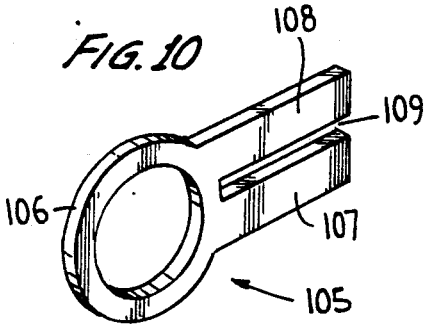
FIG. 10 is a view in perspective of a mounting bracket utilized for the motor illustrated in FIG. 9.
Figure 9:
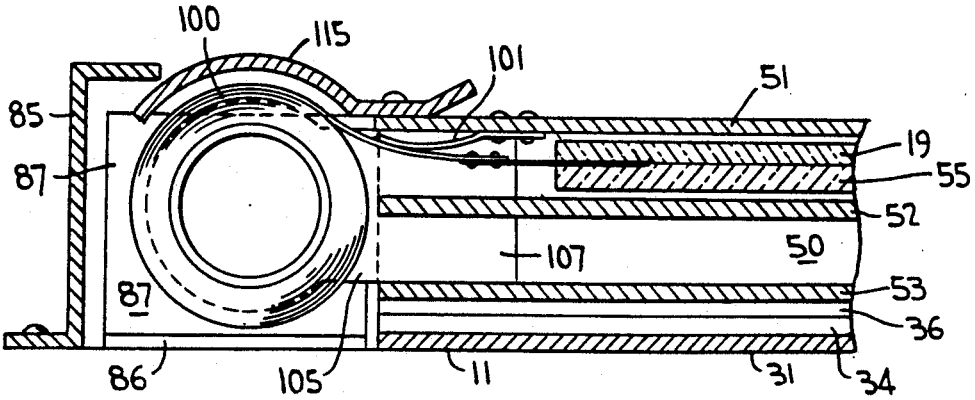
FIG. 9 is a view is section taken along lines 9—9 of FIG. 11 showing the mounting of the motor used to move the panels of the storm shutter assembly of FIG. 1.
Figure 11:
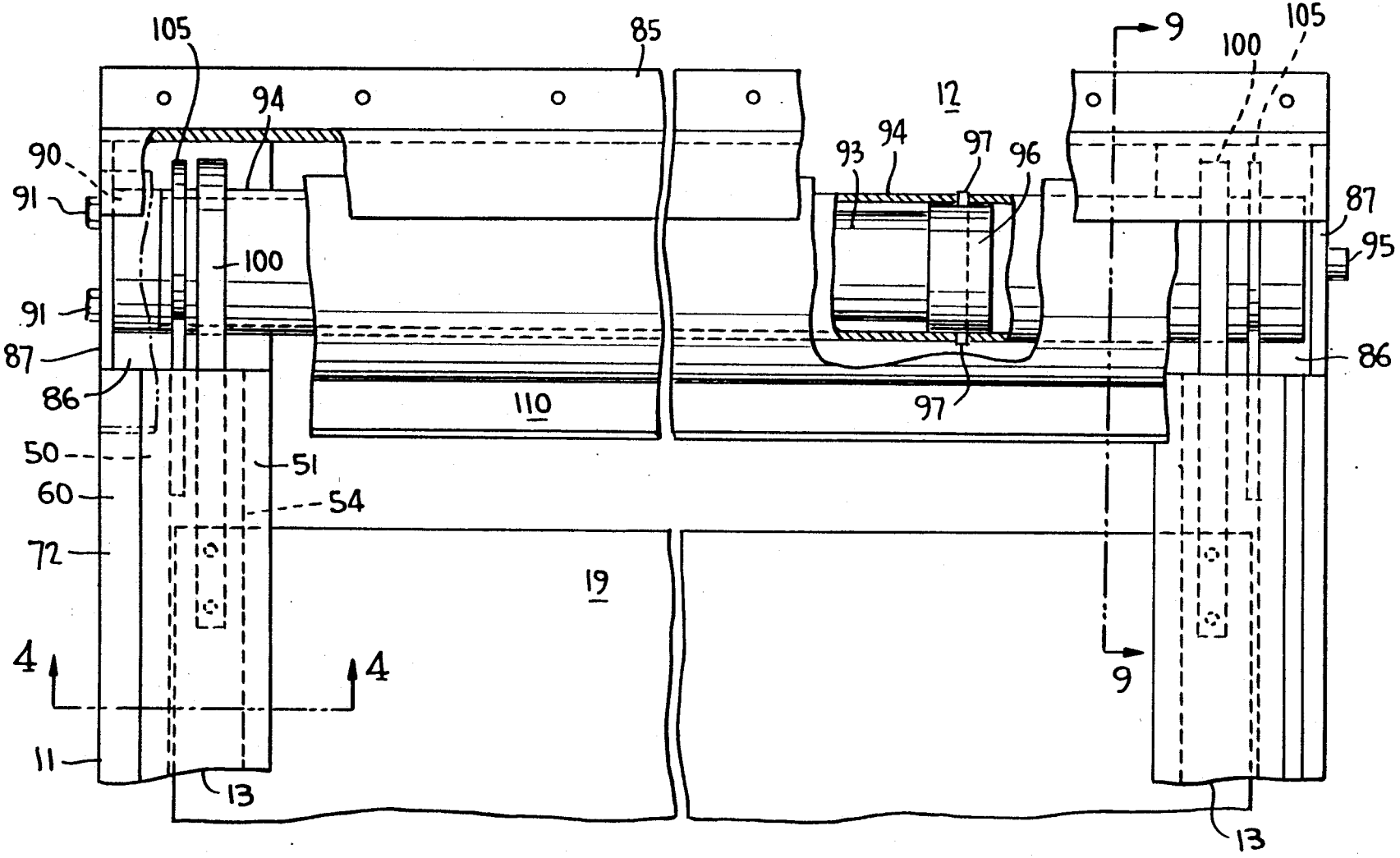
FIG. 11 is a front view, partially broken, of the upper portion of the storm shutter assembly of FIG. 1 showing the drive motor and its relationship to the slidable panels.
Figure 12:
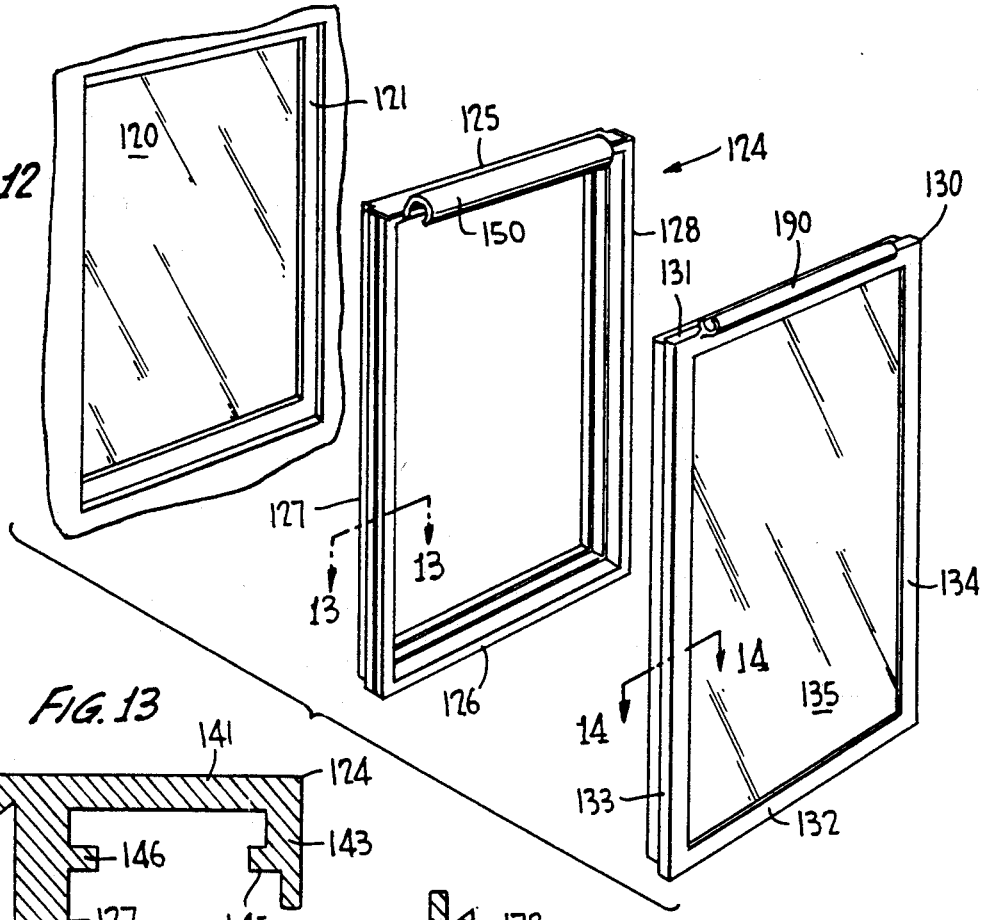
FIG. 12 is an exploded view in perspective showing a second embodiment of the storm shutter of the present invention wherein a single fixed transparent panel is employed.
Figure 13:
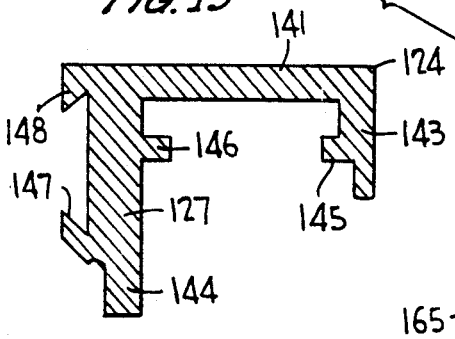
FIG. 13 is a view in transverse section taken along lines 13—13 of FIG. 12.
Figure 15:
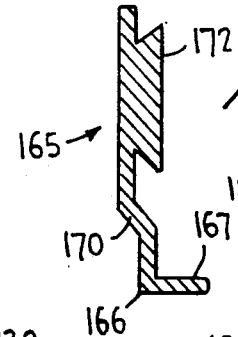
FIG. 15 is a view in transverse section of the locking retainer employed in the embodiment of FIG. 12.

Referring now to FIGS. 9, 10 and 11, secured to building structure wall 12 immediately above casing 11 is a fixed rain shield 85 having a mounting flange portion secured to wall 12, a horizontal projection extending perpendicularly forward from the mounting flange portion, and a depending lip extending perpendicularly downward from the forward edge of the horizontal projection. The horizontal projection and lip serve to cover the top of the assembly and protect it against rain, snow, etc. Fixed rain shield 85 extends entirely across the lateral dimension of the shutter assembly. Immediately below the mounting flange of shield 85 are two mounting brackets 86 secured to the upper end of respective rear track walls 31 at opposite lateral ends of the assembly. Each mounting bracket 86 is an L-shaped member having one leg secured to casing 11 at wall 31 and the other leg 87 projecting forwardly therefrom in a vertical plane to define a respective lateral end of the top of the casing 11.

A drive motor assembly is secured to and extends between the two mounting brackets 86. Specifically, a drive motor 90 is mounted on leg 87 of one of the flanges 86 by means of a pair of screws 91 extending through suitably provided holes in the leg 87 into tapped bores in the motor 90. Motor 90 may be a Model 406 tubular operator motor manufactured by SIMU and includes a drive shaft that turns an elongated motor tube 93 positioned to extend horizontally toward leg 87 of the opposite mounting flange 86. Motor tube 93 does not extend the full lateral dimension of the shutter assembly but is disposed concentrically within an outer hollow tube 94 that does extend substantially across the assembly. A stub shaft 95 secured to the distal end cover of tube 94, in coaxial relation to the motor drive shaft, is journaled in a suitable bearing hole defined through leg 87 of the opposite mounting bracket. An annular spacer 96 disposed about the distal end of motor tube 93 includes a plurality of pins 97, or the like extending radially therefrom through holes in outer tube 94 in locking engagement with the outer tube 94 to serve as a spacer between the two tubes while permitting the motor tube 93 to rotatably drive the outer tube 94. Motor 90 is actuated by a switch (not shown) having three positions, namely off, up and down. If the motor is driven by a.c. power, three wires are connected directly from the motor to the switch; if d.c. power is utilized, only two wires are required. In either case, the motor can be operated in either rotational direction or shut off by wiring the switch in a conventional manner. The switch is typically located inside the building structure adjacent window opening 14.

Proximate each end of tube 94 is a respective flexible strip 100 of stainless steel, or the like, circumferentially wound about the tube. One end of each strip is secured to tube 94, the other end being secured to the interior surface of transparent exterior panel 19 between the panel and the thickening strip 55 secured to the panel. For this purpose, a suitable notch may be provided in the panel to receive strip 100, and the strip may be secured to the panel by means of screws, adhesive or other suitable means. The length of strips 100, and accordingly the number of circumferential windings they make about tube 94, is determined by the distance to which the strip must extend to permit panel 19 to slide down to its lowermost position in the frame. Panel 19 is thusly supported by strips 100 which either pull the panel up or permit it to slide downwardly, depending upon the selected direction of rotation of drive motor 90. As described hereinabove, the raising and lowering of exterior panel 19 controls raising and lowering of interior panel 21 by virtue of the interaction between respective engagement flanges 25 and 29 (FIG. 2).

In order to prevent the support strips 100 from becoming slack or being wound about unintended portions of tube 94, a guide ramp 101 may be provided for each support strip. The guide ramps are secured to the upper end of each frame in the track for panel 19. As illustrated in FIG. 9, the ramp is secured to the surface of the frame wall 51 facing wall 52 and takes the form of a strip of material that bulges out into the channel to permit its respective strip 100 to ride smoothly thereon while being guided by the ramp onto its roll on tube 94.

In addition to serving a raising and lowering function for the panels, outer tube 94 serves as part of the pivot mounting by which frame 13 is pivotably mounted with respect to casing 11. Specifically, a pair of pivot members 105, disposed proximate opposite ends of tube 94, include an annular portion adapted to fit about the tube. In this regard, the tube is free to rotate within the annular portion, and suitable bearing lubricant material may be placed between the annular portion and the tube to minimize frictional wear. Pivot member 105 also includes a depending portion secured to the annular portion and bifurcated to form two depending legs 107, 108 on opposite sides of a slot 109. Each pivot member 105 is disposed against and secured to a respective frame wall 50 with its legs 107 and 108 straddling frame wall 52 so that each leg resides in the upper end of a respective track for panels 19 and 21. In this position, frame wall 52 fits snugly in pivot member slot 109. Pivot members 105 may be secured to frame walls 50 by means of screws, adhesive material, or the like. In any case, the pivot members serve to pivotably suspend the frame 13 from tube 94 and, thereby, provide the pivoting capability of the frame relative to the casing 11.

A contoured rain guard 115 is secured, by screws or the like, to the top of each side member of frame 13, the contour being such to permit guard 115 to move up under fixed rain guard 85 when the frame 13 is pivoted away from casing 11. Rain guard 110 protects the frame against exposure to rain, snow, etc., and is overlapped by the depending lip of fixed guard 85 when the frame is in its vertical orientation within the casing.

The storm shutter embodiment described above is, as described, suitable for protecting a double hung window whereby, if either or both window sashes are opened, the two transparent shutter panels may be positioned as necessary to permit unimpeded airflow through the open window. Certain principles of the present invention are also applicable for storm shutters utilized to protect fixed pane windows and doors, and an example of a storm shutter embodiment suitable for this purpose is illustrated in FIGS. 12–18. More particularly, a fixed (i.e., non-movable) pane window to be protected includes a glass pane 120 secured about its edges in a window frame 121 in a conventional manner. The window frame 121 is mounted in a window opening 122 defined in a building structure 123. The fixed pane unit could also be a door, and it could have plural fixed panes; the storm shutter embodiment described below is suitable for each of these applications.

A rectangular storm shutter casing 124 is secured directly to the outside surface of window frame 121 by means of a suitable adhesive material 119, or the like. Alternatively, the casing may be secured to the window frame by screws, bolts, etc., or the casing may be secured to the building structure about the window opening. However, it is particularly advantageous to secure the casing to the frame of the window or door being protected. Typically, the window frame is wood and the casing 124 is aluminum; however, other materials, including metals, woods and plastics, may be employed, and the adhesive material is chosen accordingly. Casing 124 includes a top member 125, a bottom member 126 and side members 127, 128, all of which are extrusions having substantially similar transverse cross-sectional configurations, it being noted that the top member 125 differs from the other members in order to provide part of a hinge structure permitting the shutter frame to pivot relative to the casing. The space surrounded by the casing members 125, 126, 127 and 128 is large enough to leave window pane 120 clear and unblocked.

Casing side member 127, which is identical to side member 128 and bottom member 126, includes a rear wall 141 disposed flush against window frame 121. An inner casing edge wall 143 extends perpendicularly forward from the inner edge of wall 141 (i.e., the edge disposed adjacent window pane 120). An outer edge wall 144 projects forwardly from rear wall 141 at a location at the opposite side of rear wall 141 from edge wall 143. Typically, the forward length of casing edge wall 144 is the same as, or slightly less than, the lateral length of rear wall 141. A flange 145 projects from inner edge wall 143 toward outer edge wall 144, and a similar flange 146, coplanar with and spaced from flange 145, projects from outer edge wall 144 toward inner edge wall 143. Flanges 145 and 146, with rear wall 141, establish a rectangular channel having a narrowed opening defined between the spaced facing flange ends. The channel serves as a space for receiving a plurality of threaded bolts securing the casing to the window frame or building wall if adhesive material is not employed for that purpose. Suitable washers 18 are disposed in the defined channels between the heads of the bolts and wall 141. A projection 147 extends outwardly from the outer surface of edge wall 141 and takes the form of two spaced and outwardly converging walls extending the entire length of side member 127 and defining a trapezoidal-shaped channel 148 between them. Channel 148 opens outwardly of the casing along the smaller of the two trapezoidal bases.

Casing side member 128 and casing bottom member 126 (FIG. 17) are identical to side member 127. Casing top member 125 (FIG. 17) differs from the side and bottom members in three respects. First, the inner edge wall 143 terminates at flange 145 and is therefore considerably shorter in top member 125 than in the other casing members. Second, the forwardmost edge of wall 141 is provided with an outer hinge member 150 in the form of a hollow partial cylinder extending laterally across (i.e., into the plane of the drawing) the entirety of top member 125. Hinge member 150 is a "partial" cylinder because approximately ninety degrees of its circumference is cut-away at the portion of member 150 facing downward along the front of the casing. Finally, top member 125 has no outer projection 147 and no trapezoidal channel defined thereby.

Storm shutter frame 130 has its side members 133, 134 and its bottom member 135 identically configured. Each has a forward wall 151, and a rear wall 153 oriented parallel to forward wall 151 and spaced therefrom by an outer wall 152 oriented perpendicular to walls 151 and 153. An inner wall 154 extends perpendicularly from the opposite end of rear wall 153 toward forward wall 151 but terminates short of the forward wall to define an opening 155. Walls 151, 152, 153 and 154 thus define a track extending the length of member 133, the track being enclosed except for the narrow opening 155.

Rear wall 153 of the frame side members and top and bottom members rests on the forward-facing surfaces of flanges 145 and 146 of respective side, top and bottom members of the casing. The extensions of inner casing wall 143 forwardly beyond flange 145 on the casing bottom and side members cooperate with wall 144 and the flanges to define a receiving space for the corresponding members of frame 130. The receiving space in the casing, as thusly defined, is slightly larger than the dimensions of the frame so as not to interfere with movement of the frame relative to casing 124 when the frame is pivoted outwardly as described hereinbelow and as best illustrated in FIG. 17. This pivotal movement corresponds to downward movement of frame 130 as viewed in FIG. 16.

Figure 16:
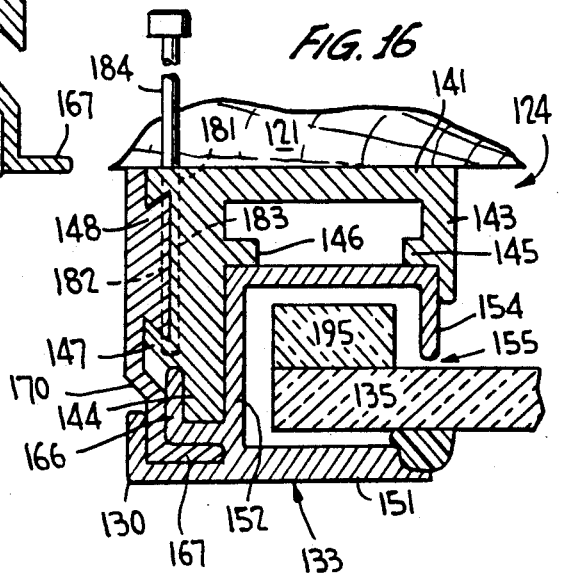
FIG. 16 is a view in transverse section showing the elements of FIGS. 13, 14 and 15 joined together as part of an overall assembly.
Figure 14:
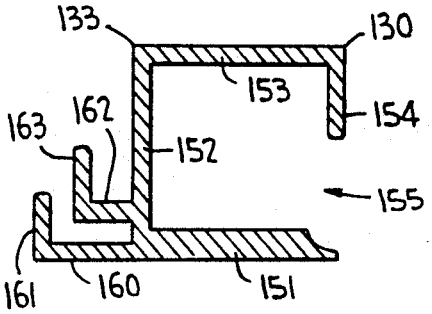
FIG. 14 is a view in transverse section taken along lines 14—14 of FIG. 12.
Figure 17:
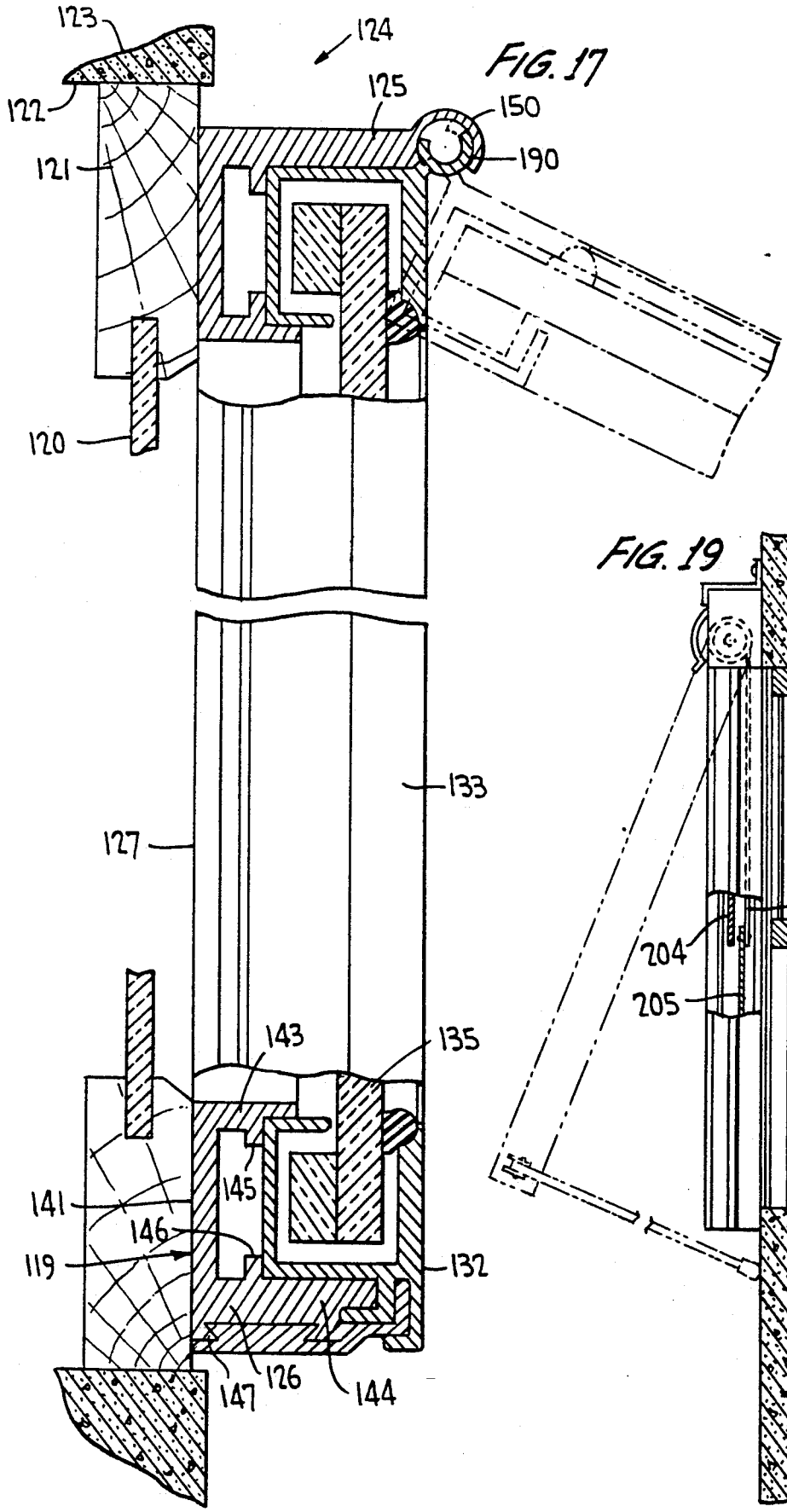
FIG. 17 is a side view in elevation and partial section of the shutter assembly of FIG. 12.
Figure 18:
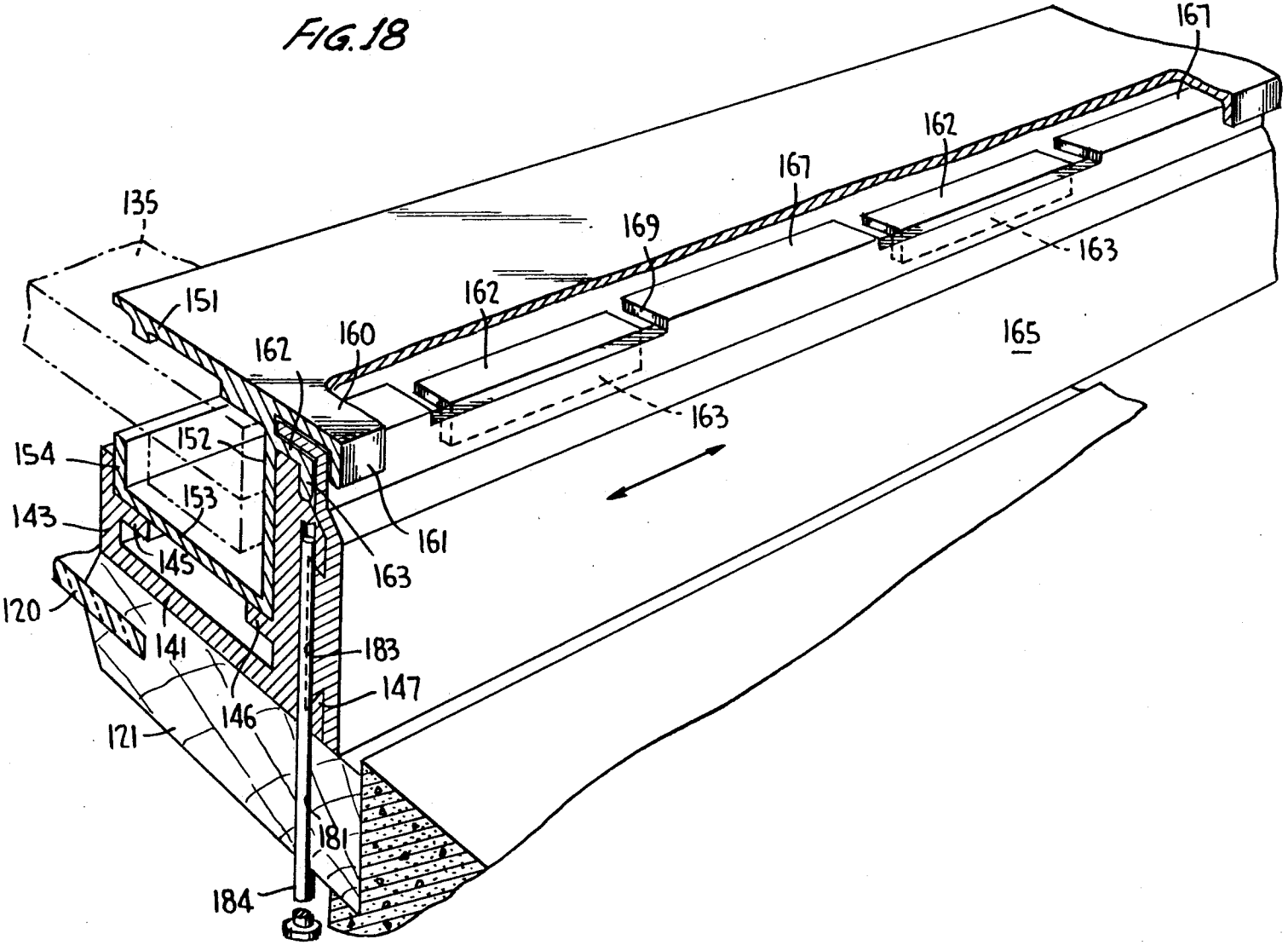
FIG. 18 is a view in perspective, partially broken, showing the locking arrangement for the shutter assembly of FIG. 12.

During normal operation of the storm shutter assembly illustrated in FIGS. 12–18, frame 130 is locked in place in casing 124 so that the frame cannot be pivoted in hinge member 150. The locking arrangement is similar to that described above for storm shutter assembly 10, but it is not spring actuable from inside the building because emergency egress is not possible through the protected fixed pane of the window or door. However, the lock is tamper-proof so as to prevent vandals and burglars from unlocking the frame from the casing. The structure for locking frame 130 to casing 124 is illustrated in FIGS. 16, 17 and 18 to which specific reference is now made.

Each of the side and top members of frame 130 includes a cover flange 160 extending outwardly from the junction of walls 151 and 152, coplanar with and in the opposite direction from wall 151. Thus, flange 160 extends outwardly from the framed space and, like walls 151, 152, 153 and 154, extends the entire vertical dimension of the frame (i.e., into the plane of the drawing in FIG. 14). The distal end of cover flange 160 is bent perpendicularly back toward the building structure wall to define a cover lip 161 having a length typically between seventy and seventy-five percent of the lateral dimension of the cover flange. A locking flange 162 extends laterally outward from frame wall 152 in spaced parallel relation to cover flange 160 at a location slightly interior from the cover flange. Locking flange 162 extends laterally a significantly shorter distance than does cover flange 160 before bending back toward the building structure to define a locking lip 163. The location of locking flange 160 along wall 152 is such that, if it were extended without bending to form locking lip 163, it would contact cover lip 161. The bend in locking flange 162 defining locking lip 163 is slightly more than ninety degrees (e.g., typically on the order of ninety-three degrees) so that it converges slightly toward frame wall 152. At its lateral extremity (i.e., at the bend), the lateral length of locking flange 162 is approximately half the lateral length of cover flange 160. Locking lip 163 has a length substantially the same as the length of cover lip 161. The result is a channel having a generally L-shaped cross-section extending the entire length dimension of the frame member between cover flange 160 and lip 161 on the one hand, and the locking flange 162 and lip 163 on the other hand. A channel of linear cross-section extends the entire length of the frame member and subsists between locking lip 163 and the outer surface of frame wall 152. This linear channel receives the distal portion of edge wall 144 of casing 124. In this regard, the distal portion of wall 144 narrows slightly so that it may be accommodated between the frame wall 152 and the distal end of the slightly converging locking lip 163.

As best illustrated in FIG. 18, locking flange 162 and lip 163 have a plurality of recesses defined therein at spaced locations along the length of the frame member. These recesses, extending entirely through the locking lip 163, but only part way through the locking flange 162, establish a series of locking tabs formed by the non-recessed portions of the flange and lip. The tabs and the recesses therebetween cooperate with a separate locking retainer 165 configured to releasably secure frame 130 to casing 124. There are three such locking retainers provided with this storm shutter assembly, one for each of the sides and one for the bottom of the frame/casing. Each locking retainer 165 is an elongated plastic or metal member extending throughout that portion of the length of locking flange 162 and lip 163 in which the alternating recesses and tabs are defined. One side of locking retainer 165 is in the form of a retainer flange 166 of L-shaped transverse section configured to be slidably received in the L-shaped channel defined between cover flange 160 and locking flange 162. Retainer flange 166 includes a distal leg 167 disposed between flanges 160 and 162, and a proximal leg disposed between lips 161 and 163. Distal leg 167 is entirely cut-away at a series of longitudinally spaced locations 169 to define a series of retainer recesses separated by a series of regularly spaced retainer tabs corresponding to the non-recessed portions of distal leg 167. The longitudinal spacing between the retainer tabs 167 corresponds to the spacing between the locking tabs in locking flange 162 and locking lip 163. The longitudinal dimensions of the locking tabs and retainer tabs are preferably the same; however, the longitudinal tab dimensions are preferably shorter than the longitudinal dimensions for the locking recesses and retainer recesses. With these retainer relationships, when retainer 165 is longitudinally positioned such that its retainer tabs 167 are aligned or juxtaposed with locking tabs of flange 162, the frame 130 is prevented from pivoting away from casing 124 due to the interference between the two sets of tabs. In other words, retainer 165 is secured to casing 124 and, by disposing its retainer tabs 167 in blocking relation to the frame locking tabs 162, the retainer prevents the frame from moving away from the casing (i.e., upward in FIG. 18, downward in FIG. 16).

When retainer 165 is caused to slide vertically until its retainer tabs are aligned with locking recesses in flange 162, the interference between the two sets of tabs is removed. Since distal retainer leg 167 is laterally shorter than the depth of the recesses in flange 162, the retainer tabs pass freely through those locking recesses as the frame is pivoted forwardly and away from the casing.

The proximal retainer leg of flange 166 extends perpendicularly toward casing rear wall 141 alongside locking lip 163. Proximate the distal end of the locking lip, the retainer is provided with a substantially planar segment 170 that bends at an angle corresponding to the angle made by projection 147 on casing 124. Segment 170 terminates at a retainer segment 171 extending to the forward edge of retainer 165. Retainer segment 171 is provided with a flange 172 of trapezoidal cross-section projecting inwardly toward the casing an configured and positioned to be slidably received in channel 148 of projection 147. This slidable engagement provides stable slidable mounting support for the retainer 165 on casing 124.

As described above, the embodiment of FIGS. 12–18 covers a window or door in which the protected pane or panes do not move. Accordingly, it is not necessary to provide a spring actuated locking mechanism to move retainer 165 for purposes of providing rapid emergency egress from the protected building. Retainers 165 are, instead, movable by hand from outside the building to align the tabs of the retainer with the recesses of flange 162 and thereby permit the frame to be pivoted away from the casing for purposes of maintenance and cleaning. All three retainers 165 can be moved in this manner, and can also be slid back into a locking position wherein the retainer tabs and tabs on flange 162 are juxtaposed.

If the storm shutter assembly of FIGS. 12–18 is also intended to protect against vandals and burglars, it is desirable to prevent unauthorized sliding of the retainers 165. This may be achieved in the manner illustrated in FIG. 16 by providing a cylindrical bore hole 181 perpendicularly through casing rear wall 141 proximate the outer edge of that wall and extending as a semi-cylindrical bore 183 across the base of channel 148. A corresponding semi-cylindrical bore 182 is defined across flange 172 so that when the two semi-cylindrical bores 182 and 183 are in mutually facing juxtaposed relation, a pin or bolt 184 can be extended through bore hole 181 and the aligned semi-cylindrical bores 182 and 183. With pin 184 thusly positioned, retainer 165 is prevented from sliding relative to casing 124. The bores are positioned such that they are aligned when retainer 165 is in its locked position. Bore 181 is also aligned with a similar hole in the frame 121 of the window so that the head of pin 184 extends inside the building and is only accessible therefrom.

Pivoting of the frame 130 relative to casing 124 when retainers 165 are unlocked is achieved by providing a "partial" hollow cylindrical hinge projection 190 from the intersection of frame walls 151 and 152 in top frame member 131. Projection 190 and the absence of flanges 160 and 162 are the principle differences between top frame member 125 and the side and bottom members of the frame. Projection 190 is considered partially cylindrical because a circumferential segment of approximately one hundred forty degrees is cut-away therefrom. The outer diameter of projection 190 is slightly smaller than the inside diameter of hinge member 150 of frame 124 to permit the two hinge members to slidably rotate smoothly, one within the other, when hinge member 190 is concentrically disposed in hinge member 150. The circumferentially cut-away portions of hinge members 150 and 190 permit the inner hinge member 190 to be removed from the outer hinge member 150 when frame 130 is rotated to its uppermost position, whereby the frame can be separated from the casing to facilitate maintenance and cleaning.

For this embodiment the transparent panel 135 is retained in tracks along each of its four edges. The tracks have a lip defined by wall 154 to loosely retain a thickened portion of the panel edge in the respective track. In the preferred embodiment, the increased thickness of the panel is provided by securing a strip 195 along the entire length of the interiorly facing surface of panel 135 adjacent each of the panel edges. Of course, a plurality of shorter vertically spaced strips or pieces may be utilized for the same purpose. Strip 195 is made either from the same material as panel 135 or from a material having substantially the same coefficient of thermal expansion as the panel material. Alternatively, panel 135 and strip 195 may be extruded with thickened edges as a single piece of polycarbonate, or the like, rather than adhesively securing separate strips to provide the required edge thickness. The depth of the four tracks for panel 135 is larger than the depth of the combined panel and strip, thereby allowing for thermal expansion of the panel in all four tracks and precluding damage to the frame by virtue of such expansion. However, in spite of the slack providing the freedom for thermal expansion, the panel cannot be removed transversely through the reduced width track opening due to the increased thickness provided by strip 195, or its equivalent. Thusly supported in four tracks on opposite sides of the frame, fixed panel 135 is also capable of resiliently bending, due to high winds, or the like, without thickened edges 195 being pulled through the narrower track openings.

Figure 19:
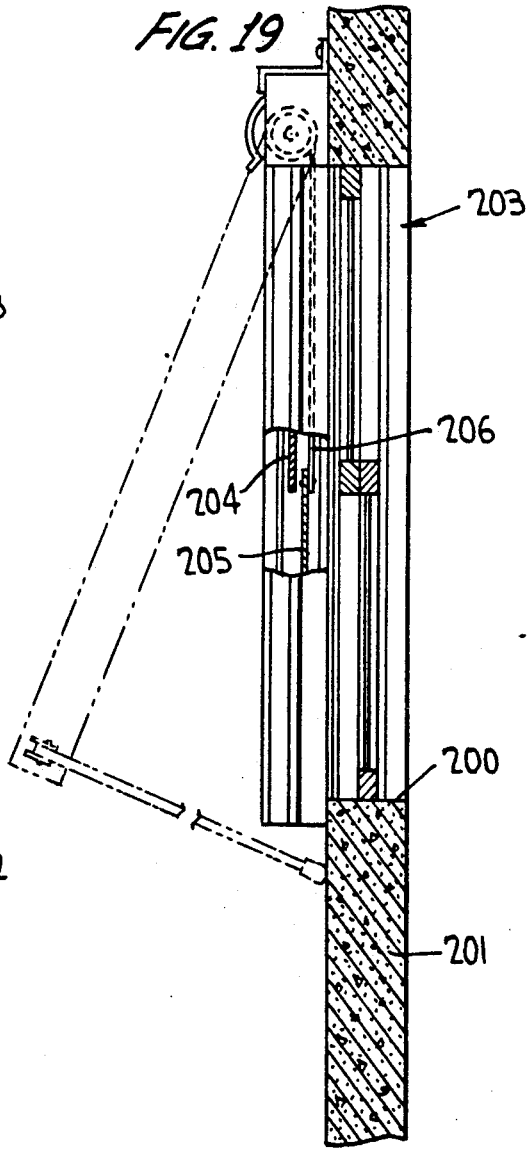
FIG. 19 is a side view in elevation and partial section of a sliding panel storm shutter of the present invention for use in protecting a single hung window.

The storm shutter embodiment described above in relation to FIGS. 1–11 is intended to protect a double hung window with shutter panels that are movable to permit full clearance of both window sashes for ventilation. The same principles apply for protecting a single hung window, and a storm shutter embodiment of the present invention suitable for that purpose is illustrated in FIG. 19. Specifically, it will be noted that this embodiment is similar to the one illustrated in FIG. 2 with the following exceptions. The bottom members of the shutter frame and casing are disposed immediately below the bottom of the window opening 200 in the building wall 201 rather than providing additional space below the window opening for the shutter panels to be stowed. The shortened frame and casing is made possible because only one of the window sashes 202 in the protected single hung window 203 is movable, it being assumed herein that the movable sash 202 is the lower sash on the interior set of tracks. Thus, the shutter panels 204, 205 need only provide clearance for the lower sash 202 and, accordingly, only the lower shutter panel 205 is movable in its tracks. In this regard, support strips 206 from the motor are secured to the lower panel 205 proximate its upper edge, rather than to the upper panel 204 as in the case of the embodiment of FIGS. 1–11. The lower panel 205 is thus selectively raised or lowered, depending upon the motor rotation direction, and there are no engagement flanges on the shutter panels since the upper panel 204 is permanently positioned in the upper end of the frame. This permanent positioning of the upper panel 204 is typically provided by closing off the exterior tracks, or by placing a flange, pin or other blocking member across those tracks, directly below the bottom edge of the upper frame to prevent it from moving downward. When the lower shutter panel is pulled upward in juxtaposition with the fixed upper shutter panel, complete clearance is provided for the lower sash 202 of the protected window 203 which may be opened to any degree. In all other respects the embodiment illustrated in FIG. 19 is the same as that illustrated in FIGS. 1–11.

It is to be understood that one of the important features of the present invention is the utilization of suitable means to effectively increase the thickness of the edges of the transparent storm shutter panels so that the panels are reliably retained in their support tracks while being held therein with sufficient slack or looseness to permit the panels to expand at a different rate than the frame material in response to temperature changes. However, it should be noted that the material for fabricating the transparent storm shutter panels may not necessarily have a significant coefficient of thermal expansion (i.e., in relation to the supporting frame). For example, tempered glass with a security film on its interior surface may be utilized for the transparent panel, the thermal expansion of tempered glass being substantially negligible. Therefore it may not be necessary to provide a thickening of the panel edges with a loose fit when tempered glass is utilized. However, other important features of the invention are applicable irrespective of the transparent panel material. For example, those features include: the use of slidable retainer locking arrangement; the spring loaded actuation of the slidable retainer for the movable panel embodiments; the dual function of the motor driven tube, namely raising and lowering one of the panels while providing a pivot axis for the frame relative to the casing; the engagement flanges permitting one panel to raise and lower the other panel in the double hung window protective embodiment; the permanently installed storm shutter assembly providing undistorted light transmission (i.e., transparency, as opposed to translucency); and the attachment of a single fixed panel shutter assembly directly to the frame of the protected door or window.

It is also to be understood that the embodiments of FIGS. 1–11 and the embodiment of FIG. 19 are designed for vertical movement of the transparent shutter panels. The principles of the present invention are equally applicable to storm shutters for protecting windows having sashes that slide horizontally, whereby the vertical orientation of the tracks permits the use of gravitational forces as means for biasing the shutter panels in opposition to the pulling forces exerted by the motor. A storm shutter for such applications would have the panel drive motor positioned along one vertical side of the frame with its rotating tube vertically oriented. Since gravitational forces cannot be used to bias the horizontally translatable panels against the pulling forces of the motor exerted through the support strips, other bias means would be employed. By way of example only, compression springs, typically located in the frame tracks, can be secured between the side of the frame opposite the motor and the edge of the panel opposite the motor to continuously urge the panel away from the motor. Of course, other types of bias mechanisms may be used for this purpose. For the double hung embodiment, both panels would be so biased; for the single hung embodiment, only the motor-driven panel would be biased. In order to protect windows or doors that open and close by pivoting on hinges, or the like, rather than sliding in tracks, the storm shutter embodiment illustrated in FIGS. 12–18 would typically be employed whereby the shutter casing would be secured to the frame of the pivotable window or door member.

As noted above, the thickening of the edges of the transparent shutter panels can be obtained in any of a variety of ways including affixing a series of metal or plastic pieces along the panel edges, extending rivets or pins through the panel edges, defining slots in the panel edges with projections extending through those slots, etc.

Although certain dimensions have been mentioned herein by way of example, it is to be understood that those dimensions relate only to a specific embodiment and are not limiting as to the scope of the invention.

From the foregoing description it will be appreciated that the present invention makes available a novel storm shutter assembly that can be permanently installed over a glass window or door without impeding light transmission through the window or door and without interfering with ventilation when the protected window or door is open.

Having described preferred embodiments of a new and improved storm shutter assembly constructed in accordance with the principles of the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What I claim is:

1. A storm shutter assembly for protecting a glass window or door, said assembly comprising:

a shutter frame including at least first and second opposite sides having respective first and second tracks defined therein extending lengthwise in mutually facing parallel relation, each track having a width and a depth defining a transverse cross-sectional configuration, and a track opening defined along part of said depth and along the track length; and a panel of transparent material having the characteristic of bowing resiliently in response to hurricane force winds and manually applied forces of similar magnitude and having sufficient strength to resist breaking while bowing, said panel having first and second opposite edge portions extending through said track openings into said first and second tracks, respectively, wherein portions of said panel adjacent said edge portions have a thickness smaller than said track openings to permit said panel to extend into said track through said track openings, said panel including edge portion enlarging means at said first and second edge portions for preventing said first and second edge portions from being removed from said first and second tracks, respectively, through said track openings in response to bowing of said panel;

wherein said first and second tracks retain said first and second edge portions, respectively, to maintain said panel in said frame while permitting transverse movement of said first and second edge portions within said first and second tracks, respectively.

2. The storm shutter assembly according to claim 1 wherein said shutter frame is made of a frame material having a relatively low coefficient of thermal expansion, wherein said transparent panel material has a relatively high coefficient of thermal expansion, and wherein the transverse cross-sectional area of said panel edge portion combined with said enlarging means is sufficiently smaller than said predetermined cross-sectional configuration of each track to permit thermal expansion of said panel relative to said frame without interference over a range of temperatures expected to be experienced by said storm shutter assembly in use.

3. The storm shutter assembly according to claim 2 wherein said frame material is metal and said panel material is plastic.

4. The storm shutter assembly according to claim 3 wherein said frame material is aluminum and said panel material is polycarbonate glazing material.

5. The storm shutter assembly according to claim 4 wherein said edge portion enlarging means comprises first and second strips of said polycarbonate glazing material extending lengthwise along one surface of said panel adjacent said first and second edges, respectively.

6. The storm shutter assembly according to claim 2 wherein said edge portion enlarging means comprises a first and second series of longitudinally spaced individual members secured to a surface of said panel at said first and second edge portions, respectively.

7. The storm shutter assembly according to claim 2 wherein said first and second tracks are longer than said first and second edge portions of said panel, and wherein said first and second edge portions of said panel are slidable longitudinally in said first and second tracks, respectively, to thereby permit said panel to be moved longitudinally in said frame.

8. The storm shutter assembly according to claim 7 further comprising selectively actuable drive means for selectively sliding said panel in said tracks.

9. The storm shutter assembly according to claim 8 wherein said drive means comprises:

a drive shaft mounted at one end of said first and second tracks for rotation about a rotation axis oriented generally perpendicular to the longitudinal dimensions of said tracks;

a selectively actuable motor for selectively rotating said drive shaft about said rotation axis in first and second rotation directions;

at least first and second flexible support strips wound about and secured to said drive shaft at spaced axial locations along said rotation axis so as to be further wound about said drive shaft as it rotates in said first rotation direction and unwound from said drive shaft as it rotates in said second rotation direction, each support strip having a distal end secured to said panel such that rotation of said drive shaft in said first rotation direction causes said support strips to pull said panel in said tracks toward said drive shaft, and such that rotation of said drive shaft in said second rotation direction permits said panel to be moved in said tracks in a direction away from said drive shaft; and bias means for continuously applying a force to said panel in a direction away from said drive shaft.

10. The storm shutter assembly according to claim 9 wherein said bias means comprises means for mounting said shutter frame with said tracks oriented vertically and with said drive shaft at the top of said frame to permit gravitational forces to continuously urge said panel downwardly and away from said drive shaft.

11. The storm shutter assembly according to claim 10 wherein said first and second flexible support strips are secured to said first and second edge portions, respectively, of said panel so as to be disposed in said first and second tracks, respectively.

12. The storm shutter assembly according to claim 11 wherein said panel is a first of first and second panels, said shutter frame further including third and fourth tracks defined in said first and second frame sides, respectively, extending lengthwise in mutually facing parallel relation and parallel to said first and second tracks, said third and fourth tracks each having said width and depth defining said transverse cross-sectional configuration and a track opening defined along part of said depth and along the track length; and wherein said second panel is made of said transparent material and includes first and second opposite edge portions extending through said openings into said third and fourth tracks, respectively, wherein portions of the second panel along its edge portions have said thickness smaller than said openings of said third and fourth tracks to permit said second panel to extend therethrough into said third and fourth tracks, said second panel including edge portion enlarging means at its first and second edge portions for preventing its first and second edge portions from being removed from said third and fourth tracks, respectively, through said track openings in response to bowing of said second panel;

wherein said third and fourth tracks retain said first and second edge portions, respectively, of said second panel to maintain said second panel in said frame while permitting transverse movement of said first and second edge portions of the second panel within said third and fourth tracks, respectively.

13. The storm shutter assembly according to claim 12 wherein said third and fourth tracks are longer than said first and second edge portions of said second panel, and wherein said first and second edge portions of said second panel are slidable longitudinally in said third and fourth tracks, respectively, to thereby permit said second panel to be moved longitudinally in said shutter frame.

14. The storm shutter assembly according to claim 13 wherein said assembly has a closed position wherein said first panel is disposed closer to said drive shaft than is said second panel, said assembly further comprising engagement means for positionally fixing said second panel relative to said first panel in said closed position of said assembly.

15. The storm shutter assembly according to claim 13 further comprising:

a first engagement flange secured to said first panel proximate an edge of said first panel most remote from said drive shaft, said first engagement flange extending generally toward said second panel;

and a second engagement flange secured to said second panel proximate an edge of said second panel closest to said drive shaft, said second engagement flange extending generally toward said first panel from a location closer to said drive shaft than is said first engagement flange and in interfering relation with said first engagement flange such that said first panel pulls said second panel toward said drive shaft when said first panel is being pulled to said drive shaft and said engagement flanges are in contact with one another; and further bias means for continuously urging said second panel away from said drive shaft.

16. The storm shutter assembly according to claim 15 further comprising mounting means for mounting said shutter frame for pivotal movement between open and closed conditions relative to said door or window to permit emergency access through the protected window or door in said opened condition.

17. The storm shutter assembly according to claim 16 further comprising:

a selectively actuable locking retainer movable to alternatively lock and unlock said shutter frame relative to said mounting means, wherein said shutter frame is free to be pivoted to said open condition when unlocked but is precluded from being pivoted from said closed condition when locked; and latching means for inhibiting movement of said locking retainer to unlock said shutter frame, said latching means having an actuator accessible only from inside a building in which the protected window or door is mounted for selectively actuating said latching means to permit movement thereof and concomitant unlocking of said shutter frame.

18. The storm shutter assembly according to claim 17 wherein said mounting means for mounting said shutter frame comprises:

a casing configured to receive and peripherally surround said shutter frame in said closed condition of said shutter frame, wherein said casing is adapted to be secured to said building in a position surrounding an opening for the protected door or window;

wherein said drive shaft is mounted in fixed relation to said casing; and a pivot engagement fixedly secured to said frame and journaled about said drive shaft to permit rotation of said frame about said drive shaft and relative to said casing.

19. The storm shutter assembly according to claim 18 wherein said pivot engagement comprises first and second pivot members each having a ring at one end disposed about and in rotational relation to said drive shaft, and having first and second spaced legs at its opposite ends, the first and second legs of said first pivot member being secured to said shutter frame in said first and third tracks, respectively, the first and second legs of said second pivot member being secured to said shutter frame in said second and fourth tracks, respectively.

20. The storm shutter assembly according to claim 12 wherein said mounting means for mounting said shutter frame comprises:

a casing configured to receive and peripherally surround said shutter frame in said closed condition of said shutter frame, wherein said casing is adapted to be secured to said building in a position surrounding an opening for the protected door or window;

wherein said drive shaft is mounted in fixed relation to said casing; and a pivot engagement fixedly secured to said frame and journaled about said drive shaft to permit rotation of said frame about said drive shaft and relative to said casing.

21. The storm shutter assembly according to claim 20 wherein said pivot engagement comprises first and second pivot members each having a ring at one end disposed about and in rotational relation to said drive shaft, and having first and second spaced legs at its opposite ends, the first and second legs of said first pivot member being secured to said shutter frame in said first and third tracks, respectively, the first and second legs of said second pivot member being secured to said shutter frame in said second and fourth tracks, respectively.

22. The storm shutter assembly according to claim 11 further comprising mounting means for mounting said shutter frame for pivotal movement between open and closed conditions relative to said door or window to permit emergency access through the protected window or door in said opened condition.

23. The storm shutter assembly according to claim 22 further comprising:

a selectively actuable locking retainer movable to alternatively lock and unlock said shutter frame relative to said mounting means, wherein said shutter frame is free to be pivoted to said open condition when unlocked but is precluded from being pivoted from said closed condition when locked; and latching means for inhibiting movement of said locking retainer to unlock said shutter frame, said latching means having an actuator accessible only from inside a building in which the protected window or door is mounted for selectively actuating said latching means to permit movement thereof and concomitant unlocking of said shutter frame.

24. The storm shutter assembly according to claim 9 wherein said mounting means for mounting said shutter frame comprises:

a casing configured to receive and peripherally surround said shutter frame in said closed condition of said shutter frame, wherein said casing is adapted to be secured to said building in a position surrounding an opening for the protected door or window;

wherein said drive shaft is mounted in fixed relation to said casing and a pivot engagement fixedly secured to said frame and journaled about said drive shaft to permit rotation of said frame about said drive shaft and relative to said casing.

25. The storm shutter assembly according to claim 1 wherein said first and second tracks are longer than said first and second edge portions of said panel, and wherein said first and second edge portions of said panel are slidable longitudinally in said first and second tracks, respectively, to thereby permit said panel to be moved longitudinally in said frame.

26. The storm shutter assembly according to claim 25 further comprising mounting means for mounting said shutter frame for pivotal movement between open and closed conditions relative to said door or window to permit emergency access through the protected window or door in said opened condition.

27. The storm shutter assembly according to claim 26 further comprising:

a selectively actuable locking retainer movable to alternatively lock and unlock said shutter frame relative to said mounting means, wherein said shutter frame is free to be pivoted to said open condition when unlocked but is precluded from being pivoted from said closed condition when locked; and latching means for inhibiting movement of said locking retainer to unlock said shutter frame, said latching means having an actuator accessible only from inside a building in which the protected window or door is mounted for selectively actuating said latching means to permit movement thereof and concomitant unlocking of said shutter frame.

28. A storm shutter assembly according to claim 1 wherein said edge portion enlarging means comprises first and second strips of said transparent material extending lengthwise along one surface of said panel adjacent said first and second edges, respectively.

29. A storm shutter assembly according to claim 1 wherein said shutter frame is generally rectangular and includes third and fourth opposite sides having respective third and fourth tracks defined therein extending laterally of the frame in mutually facing parallel relation, said third and fourth tracks each having said width and depth defining said transverse cross-sectional configuration and a track opening defined along part of said depth and along the track length; and wherein said panel is generally rectangular with third and fourth opposite edge portions disposed perpendicular to said first and second edge portions and extending through the track openings into said third and fourth tracks, respectively, said panel including said edge portion enlarging means at said third and fourth edge portions for preventing said third and fourth edge portions from being dislodged from said third and fourth tracks, respectively, through said track opening in response to bowing of said panel;

wherein said third and fourth tracks retain said third and fourth edge portions, respectively, to maintain said panel in said frame while permitting transverse movement of said third and fourth edge portions within said third and fourth tracks, respectively.

30. The storm shutter assembly according to claim 29 further comprising mounting means for mounting said shutter frame for pivotable movement between open and closed conditions relative to a frame of said protected window.

31. The storm shutter assembly according to claim 30 further comprising:

a selectively actuable locking retainer movable to alternatively lock and unlock said shutter frame relative to said mounting means, wherein said shutter frame is free to be pivoted to said open condition when unlocked but is precluded from being pivoted from said closed condition when locked; and latching means for inhibiting movement of said locking retainer to unlock said shutter frame, said latching means having an actuator accessible only from inside a building in which the protected window or door is mounted for selectively actuating said latching means to permit movement thereof and concomitant unlocking of said shutter frame.

32. The storm shutter assembly according to claim 31 wherein said mounting means for mounting said shutter frame comprises:

a casing configured to receive and peripherally surround said frame in said closed condition of said frame, wherein said casing is adapted to be secured to the frame of the protected door or window; and a hinge comprising mating hinge members secured to said shutter frame and casing, respectively, to permit rotation of said frame relative to said casing.

33. A storm shutter assembly for protecting a glass window or door mounted in an opening in a building, said assembly comprising:

a shutter casing;

a shutter frame pivotably mounted on said casing;

a shutter panel of transparent material having sufficient strength to resist breaking in response to hurricane force winds, said shutter panel being mounted in said shutter frame;

a retainer for releasably securing said shutter frame to said shutter casing to selectively permit and prevent rotation of said shutter frame relative to said shutter casing, said retainer comprising a retainer slide movable between first and second positions relative to said casing, said retainer slide in said first position blocking pivotable movement of said shutter frame relative to said shutter casing, said retainer slide in said second position permitting said pivotable movement;

wherein said retainer slide includes a retainer edge portion having a plurality of alternating tabs and recesses defined therein;

wherein said shutter frame has a frame edge facing said retainer edge and also having a plurality of alternating tabs and recesses defined therein;

wherein, in said first position of said retainer slide, said tabs of said frame edge and said tabs of said retainer slide are juxtaposed in mutually blocking relation to prevent pivoting of said shutter frame away from said shutter casing; and wherein, in said second position of said retainer slide, said tabs of said frame edge are juxtaposed with said recesses of said retainer slide to permit said shutter frame to freely rotate away from said casing.

34. The storm shutter assembly according to claim 33 further comprising:

bias means for continuously urging said retainer slide toward said second position;

actuable latching means disposed in blocking relation to said retainer slide to oppose movement of the retainer slide to said second position by said bias means; and an actuator accessible only from inside said building for selectively moving said latching means out of blocking relation to said retainer slide and thereby permit the retainer slide to be moved to said second position by said bias means.

35. The storm shutter assembly according to claim 33 further comprising latching means for positionally fixing said retainer slide relative to said casing when said retainer slide is in said first position, said latching means comprising:

a casing bore defined in said casing;

a slide bore defined in said retainer slide so as to be axially aligned with said casing bore when said retainer slide is in said first position; and pin means selectively extendable into, and removable from, said slide and casing bores when said retainer slide is in said first position for preventing said retainer slide from sliding relative to said casing and said shutter frame.

36. A storm shutter assembly for protecting a glass window or door having one or more fixed panes of glass disposed in a window or door frame, said assembly comprising:

a shutter frame;

a panel of transparent material peripherally surrounded by and secured to said shutter frame;

a shutter casing adapted to receive and peripherally surround said shutter frame when the storm shutter assembly is in use;

mounting means for mounting said shutter frame on said shutter casing;

means securing said casing directly to the window or door frame;

wherein said securing means comprises adhesive material disposed between said casing and the door or window frame;

wherein said mounting means comprises means for pivotably mounting said shutter frame on said shutter casing to permit said shutter frame to be pivoted away from said shutter casing for maintenance and cleaning;

retainer means for releasably securing said shutter frame to said shutter casing to selectively permit and prevent rotation of said shutter frame relative to said shutter casing, said retainer means comprising a first retainer slide movable between first and second positions relative to said casing, said retainer slide in said first position blocking pivotal movement of said shutter frame relative to said shutter casing, said retainer slide in said second position permitting said pivotable movement;

wherein said retainer slide includes a retainer edge portion having a plurality of alternating tabs and recesses defined therein;

wherein said shutter frame has a frame edge facing said retainer edge and also having a plurality of alternating tabs and recesses defined therein;

wherein, in said first position of said retainer slide, said tabs of said frame edge and said tabs of said retainer slide are juxtaposed in mutually blocking relation to prevent pivoting of said shutter frame away from said shutter casing; and wherein, in said second position of said retainer slide, said tabs of said frame edge are juxtaposed with said recesses of said retainer slide to permit said shutter frame to freely rotate away from said casing.

37. The storm shutter assembly according to claim 36 further comprising latching means for positionally fixing said retainer slide relative to said casing when said retainer slide is in said first position, said latching means comprising:

a casing bore defined in said casing;

a slide bore defined in said retainer slide so as to be axially aligned with said casing bore when said slide retainer is in said first position; and pin means selectively extendable into, and removable from, said slide and casing bores when said slide retainer is in said first position for preventing said slide retainer from sliding relative to said casing and said shutter frame.

* * * * *